US007416288B2

(12) United States Patent
Takatsuka

(10) Patent No.: US 7,416,288 B2
(45) Date of Patent: Aug. 26, 2008

(54) LIQUID EJECTION APPARATUS AND LIQUID TANK

(75) Inventor: Tsutomu Takatsuka, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 314 days.

(21) Appl. No.: 11/236,648

(22) Filed: Sep. 28, 2005

(65) Prior Publication Data

US 2006/0066698 A1 Mar. 30, 2006

(30) Foreign Application Priority Data

Sep. 29, 2004 (JP) ..... 2004-285107
Sep. 29, 2004 (JP) ..... 2004-285108

(51) Int. Cl.
*B41J 2/175* (2006.01)
*B41J 2/19* (2006.01)

(52) U.S. Cl. ..... 347/85; 347/92

(58) Field of Classification Search ..... 347/20, 347/21, 34, 36, 86, 90, 93, 19
See application file for complete search history.

(56) References Cited

U.S. PATENT DOCUMENTS 4,740,796 A * 4/1988 Endo et al. ..... 347/56
4,896,172 A * 1/1990 Nozawa et al. ..... 347/17
4,947,191 A * 8/1990 Nozawa et al. ..... 347/30
5,231,424 A * 7/1993 Kaneko et al. ..... 347/29
6,749,291 B2 * 6/2004 Satou et al. ..... 347/77

FOREIGN PATENT DOCUMENTS

| | | | |
|---|---|---|---|
| JP | 56-101865 | A | 8/1981 |
| JP | 63025047 | A | 2/1988 |
| JP | 2-281960 | A | 11/1990 |
| JP | 2001-315357 | A | 11/2001 |
| JP | 2001-315358 | A | 11/2001 |
| JP | 2002-200771 | A | 7/2002 |
| JP | 2002-240318 | A | 8/2002 |
| JP | 2004-285108 | | 3/2007 |

* cited by examiner

*Primary Examiner*—Anh T. N. Vo
(74) *Attorney, Agent, or Firm*—Birch, Stewart, Kolasch & Birch, LLP

(57) ABSTRACT

The liquid ejection apparatus comprises: a liquid ejection unit which ejects a liquid; a liquid storage unit which stores the liquid to be supplied to the liquid ejection unit; a plurality of flow passages through which the liquid flows; and a switching unit which holds a removable filter to trap foreign matter and switches a position of the filter so that the filter is connected to each of the plurality of flow passages in succession.

22 Claims, 17 Drawing Sheets

FIG.20

| NUMBER OF USES | NUMBER OF CLEANING OPERATIONS t | FLOW VELOCITY UPON COMPLETION OF CLEANING |
|---|---|---|
| 1 | 1 | Vo x 0.99 |
| 2 | 2 | Vo x 0.97 |
| 3 | 3 | Vo x 0.97 |
| 4 | 4 | Vo x 0.96 |
| ⋮ | ⋮ | ⋮ |

LIQUID EJECTION APPARATUS AND LIQUID TANK

BACKGROUND OF THE INVENTION

1. Field of the Invention

The present invention relates to a liquid ejection apparatus and a liquid tank, and more particularly to a liquid ejection apparatus and liquid tank which remove foreign matter from a collected liquid so that the liquid can be reused.

2. Description of the Related Art

When discarded ink is collected for reuse in an ink ejection apparatus comprising ink ejection nozzles, foreign matter such as viscous ink lumps and paper particles are typically contained in the discarded ink. Therefore, if the ink containing such foreign matter is reused as is, the ink ejection nozzles become blocked, leading to defective ink ejection. Hence, apparatuses comprising a filter for removing foreign matter from discarded ink have been proposed.

Japanese Patent Application Publication No. 2-281960 discloses an apparatus formed with an ink collection chamber in the upper portion of an ink cartridge and an ink supply chamber in the lower portion of the ink cartridge. A filter (filtration member) is provided in a connecting portion which leads from the bottom surface of the ink collection chamber into the ink supply chamber.

Japanese Patent Application Publication No. 2001-315357 discloses an apparatus in which a filter is provided in a flow passage through which discarded ink ejected from an ink ejection head is collected in an ink cartridge, and a pump for removing the foreign matter that accumulates in the filter is provided upstream or downstream of the filter. The foreign matter removed from the filter by driving the pump is discharged together with the discarded ink.

Japanese Patent Application Publication No. 2002-200771 discloses an apparatus comprising a tank (sub-tank) which supplies ink to an ink ejection head, and a tank (discarded ink tank) which collects ink ejected from the ink ejection head. A filter is provided in a connecting portion which connects the two tanks, and a pump is provided to discharge the discarded ink intermixed with foreign matter from the discarded ink tank.

Japanese Patent Application Publication No. 2001-315358 discloses an apparatus in which a filter is disposed in a flow passage through which ink ejected from an ink ejection head is collected in an ink cartridge, and a device for reducing the viscosity of the ink along the flow passage is provided upstream of the filter.

Japanese Patent Application Publication No. 2002-240318 discloses an apparatus in which a filter is disposed in a flow passage through which ink ejected from an ink ejection head is collected in an ink storage tank, and a user is encouraged to replace the filter when the flow velocity of the ink through the flow passage decreases below a predetermined threshold.

As the number of nozzles which eject the ink increases, the amount of discarded ink generated during a restoration operation such as a dry discharge or suction also increases. The foreign matter intermixed in the discarded ink is trapped by the filter, but the filter becomes blocked by the trapped foreign matter, and therefore the filter must be replaced with increasing frequency as the amount of discarded ink increases.

In the apparatus described in Japanese Patent Application Publication No. 2-281960, the foreign matter that flows into the ink collection chamber together with the collected ink settles on the bottom surface of the ink collection chamber, and as a result, the filter disposed in the connecting portion leading from the bottom surface of the ink collection chamber into the ink supply chamber becomes blocked easily by the foreign matter. This filter is provided inside the ink cartridge, and hence it is impossible to replace the filter alone when the foreign matter blocks the filter. As a result, the whole ink cartridge must be replaced, even when usable ink remains in the ink cartridge.

In the apparatuses described in Japanese Patent Application Publication Nos. 2001-315357 and 2002-200771, ink is discharged together with the removed foreign matter, and therefore the ink consumption increases.

In the apparatus described in Japanese Patent Application Publication No. 2001-315358, the viscosity of the collected ink is reduced along the flow passage, and re-melting of the impurities that are separated by evaporation requires a large amount of time. Therefore, this apparatus is inadequate.

In the apparatus described in Japanese Patent Application Publication No. 2002-240318, the user is encouraged to replace the filter with great frequency when the amount of discarded ink increases.

SUMMARY OF THE INVENTION

The present invention has been contrived in consideration of these circumstances, and it is an object thereof to provide a liquid ejection apparatus and liquid tank which enable reuse of a collected liquid without wasting the liquid, and which enable an extension of the working life of each filter.

In order to attain the aforementioned object, the present invention is directed to a liquid ejection apparatus, comprising: a liquid ejection unit which ejects a liquid; a liquid storage unit which stores the liquid to be supplied to the liquid ejection unit; a plurality of flow passages through which the liquid flows; and a switching unit which holds a removable filter to trap foreign matter and switches a position of the filter so that the filter is connected to each of the plurality of flow passages in succession.

Preferably, the switching unit switches the position of the filter using as connection subjects at least two flow passages from among a liquid supply flow passage which supplies the liquid stored in the liquid storage unit to the liquid ejection unit, a liquid collection flow passage which collects the liquid ejected from the liquid ejection unit for reuse by the liquid ejection unit, and a cleaning flow passage which removes accumulated foreign matter from the filter. In other words, the present invention includes an aspect in which the filter is connected using the liquid supply flow passage and liquid collection flow passage as connection subjects, an aspect in which the filter is connected using the liquid collection flow passage and cleaning flow passage as connection subjects, and an aspect in which the filter is connected using the liquid supply flow passage and cleaning flow passage as connection subjects. The filter may be connected to any flow passage through which the foreign matter-containing liquid flows.

By means of this constitution, the position of the removable filter is switched such that the filter is connected to a plurality of flow passages in sequence. Therefore, in comparison with a case in which the filter is discarded every time it is used up on a single flow passage, the working life of each filter can be extended, and the frequency with which the filter must be replaced can be reduced.

Preferably, the switching unit connects the filter that is connected for use to a liquid supply flow passage which supplies the liquid stored in the liquid storage unit to the liquid ejection unit, to a liquid collection flow passage which collects the liquid ejected from the liquid ejection unit for reuse by the liquid ejection unit.

By means of this constitution, the filter is used in the liquid collection flow passage after being used in the liquid supply flow passage. As a result, the working life of each filter can be extended and the frequency with which the filter must be replaced can be reduced, while the ejection performance of the liquid ejection unit is maintained.

Preferably, the switching unit connects the filter to a cleaning flow passage which removes accumulated foreign matter from the filter, and then connects the cleaned filter to at least one of a liquid supply flow passage which supplies the liquid stored in the liquid storage unit to the liquid ejection unit, and a liquid collection flow passage which collects the liquid ejected from the liquid ejection unit for reuse by the liquid ejection unit.

By means of this constitution, the filter is cleaned and reused, and therefore the working life of each filter can be extended, and the frequency with which the filter must be replaced can be reduced.

Preferably, the switching unit is capable of holding a larger number of the filters than a number of connection subject flow passages.

By means of this constitution, an unconnected stand-by filter can be connected to a flow passage when a filter is discarded, and therefore the apparatus can be operated continuously.

Preferably, the liquid ejection apparatus further comprises: a reading unit which reads identification information indicating a type of the filter from a storage unit provided on the filter; and a switching control unit which determines whether or not the filter is usable according to the identification information, and performs control to ensure that when the filter is determined to be unusable, the filter is not connected to the flow passages.

By means of this constitution, when an inappropriate filter is attached, usage of the inappropriate filter is prevented on the basis of the identification information.

Preferably, the liquid ejection apparatus further comprises a discarded filter storage unit which stores a used and discarded filter.

By means of this constitution, discarded filters can be stored in the discarded filter storage unit, and hence the discarded filters can be disposed of at once.

Preferably, the liquid ejection apparatus further comprises a filter storage control unit which determines whether the filter is a usable filter or a discarded filter according to at least one of a flow velocity of the flow passage to which the filter is connected and a usage time of the filter, and performs control to ensure that the discarded filter is stored in the discarded filter storage unit.

By means of this constitution, discarded filters are identified and stored in the discarded filter storage unit automatically, and hence a filter replacement operation can be performed easily.

Preferably, the liquid ejection apparatus further comprises a filter storage control unit which creates usage history information of the filter, determines whether the filter is a usable filter or a discarded filter according to the usage history information, and performs control to ensure that the discarded filter is stored in the discarded filter storage unit.

The storage destination of the usage history information preferably includes an IC tag provided on the filter, memory provided in the apparatus, and so on.

By means of this constitution, discarded filters are identified and stored in the discarded filter storage unit automatically, and hence a filter replacement operation can be performed easily.

Preferably, the discarded filter storage unit is formed together with the liquid storage unit in a cartridge that can be attached to and detached from a main body of the liquid ejection apparatus.

By means of this constitution, when there is no more usable liquid and the cartridge is replaced, discarded filters are removed from the apparatus when the cartridge is detached.

Preferably, the discarded filter storage unit comprises an opening/closing unit which is set in an open state enabling storage of the filter when the cartridge is attached to the main body of the liquid ejection apparatus, and set in a closed state preventing the stored filter from escaping when the cartridge is detached from the main body of the liquid ejection apparatus.

By means of this constitution, the opening/closing portion is in an open state when the cartridge is attached to the apparatus main body, and in a closed state when the cartridge is detached from the apparatus main body once all of the usable ink has been consumed. As a result, the user need not be concerned about soiling his/her hands or the like on the liquid that is adhered to the filters.

The collected liquid has different physical properties to the liquid in its initial state. For example, the collected liquid contains viscous liquid.

In order to attain the aforementioned object, the present invention is also directed to a liquid tank, comprising: a liquid supply chamber which stores a liquid to be supplied; a collected liquid chamber which stores a collected liquid; a connecting portion which connects the collected liquid chamber to the liquid supply chamber and has an opening disposed in a higher position than a bottom face of the collected liquid chamber; a foreign matter trapping body which traps foreign matter in the collected liquid chamber and is disposed between the bottom face of the collected liquid chamber and the opening of the connecting portion; and a filter which is disposed in the connecting portion and transmits the liquid from the collected liquid chamber to the liquid supply chamber, but prevents transmission of the foreign matter.

By means of this constitution, the foreign matter that flows into the collected liquid chamber together with the collected liquid settles in the collected liquid chamber and is trapped by the foreign matter trapping body. As a result, the filter can be prevented from becoming blocked by the foreign matter, and the supernatant liquid alone can be filtered through the filter and provided to the liquid supply chamber through the opening, which is disposed in a high position relative to the foreign matter trapping body. Hence the liquid supply is not halted by filter blockages, and liquid having stable physical properties can be supplied.

Preferably, the liquid tank is detachably attached to a liquid ejection apparatus which deposits the liquid in the liquid supply chamber onto a predetermined recording medium.

By means of this constitution, the foreign matter trapped in the foreign matter trapping body is collected together with the detached liquid tank when the entire liquid supply has been consumed and the liquid tank is detached from the liquid ejection apparatus.

Preferably, the liquid tank further comprises a diluting fluid chamber which stores a diluting fluid for diluting the liquid collected in the collected liquid chamber.

By means of this constitution, a diluting fluid which is suitable for the supplied liquid can be set in the liquid ejection apparatus, and the collected liquid can be diluted appropriately.

Preferably, the liquid tank further comprises a liquid property measurement sensor which measures physical properties of the liquid in the collected liquid chamber and is disposed in a higher position than an upper end of the foreign matter trapping body.

By means of this constitution, the physical properties of the liquid in the collected liquid chamber are measured by the liquid property measurement sensor, which is disposed in a higher position than the upper end of the foreign matter trapping body, and therefore the liquid in the collected liquid chamber can be reduced to a liquid having appropriate physical properties.

Preferably, the connecting portion is provided with an opening/closing device which opens and closes the connecting portion.

By means of this constitution, the timing for circulating the liquid collected in the collected liquid chamber to the liquid supply chamber can be controlled by opening and closing the connecting portion.

Preferably, the liquid tank further comprises a liquid amount measurement sensor which measures an amount of the liquid in the collected liquid chamber and is disposed in a higher position than an upper end of the foreign matter trapping body.

By means of this constitution, the amount of liquid in the collected liquid chamber can be measured by the liquid amount measurement sensor.

For example, it is possible to determine the dilution timing and the amount of diluting fluid to be injected into the liquid in the collected liquid chamber can be determined, and to determine the timing for circulating the liquid in the collected liquid chamber to the liquid supply chamber.

Preferably, the collected liquid chamber is disposed to ensure that the liquid is dropped into the liquid supply chamber from the collected liquid chamber.

By means of this constitution, the liquid in the liquid supply chamber is agitated when the liquid from the collected liquid chamber drops into the liquid supply chamber, and hence the liquid in the liquid supply chamber is homogenized.

In order to attain the aforementioned object, the present invention is also directed to a liquid ejection apparatus, comprising: the above-described liquid tank; a liquid ejection unit which ejects the liquid stored in the liquid supply chamber of the liquid tank; and a dilution control unit which controls an injection amount of a diluting fluid that is injected into the collected liquid chamber of the liquid tank, wherein the liquid that is collected in the collected liquid chamber of the liquid tank from the liquid ejection unit is diluted under control of the dilution control unit.

According to the present invention, collected liquid can be reused without waste, and the working life of each filter can be extended.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIG. 20 is an illustrative view showing an example of filter usage history information.

DETAILED DESCRIPTION OF THE PREFERRED EMBODIMENTS

Figure 1:
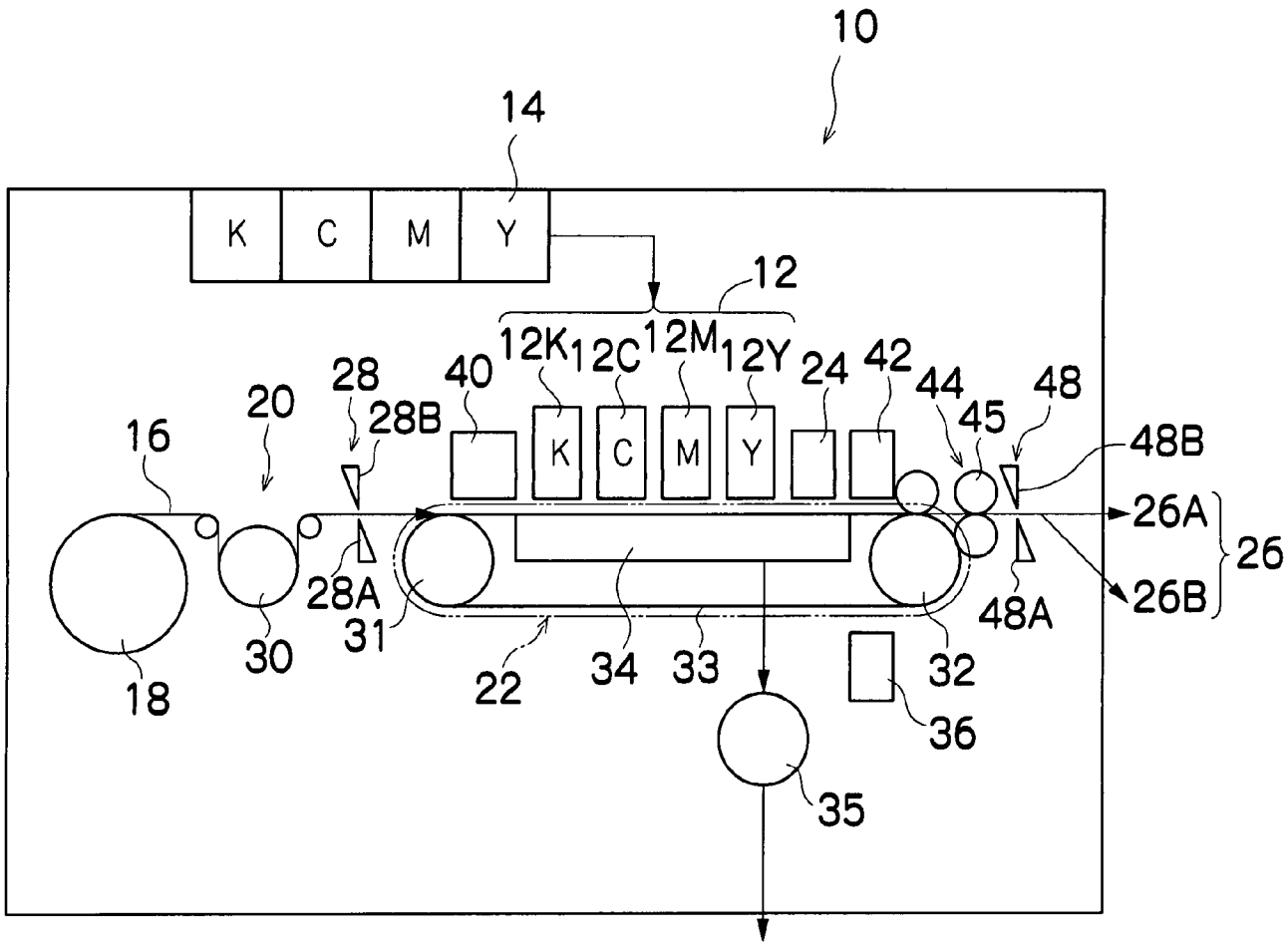
FIG. 1 is a general schematic drawing showing an outline of an embodiment of an inkjet recording apparatus to which the present invention is applied.

FIG. 1 is a general schematic drawing showing an outline of an embodiment of an inkjet recording apparatus to which the present invention is applied.

In FIG. 1, an inkjet recording apparatus 10 comprises a print unit 12 having a plurality of print heads 12K, 12C, 12M, 12Y provided for ink colors, an ink storing and loading unit 14 in which the ink supplied to the print heads 12K, 12C, 12M, 12Y is stored, a paper supply unit 18 which supplies recording paper 16, a decurling unit 20 which removes curls from the recording paper 16, a suction belt conveyance unit 22 disposed opposite a nozzle face (ink ejection face) of the print unit 12 for conveying the recording paper 16 while maintaining the flatness of the recording paper 16, a print determination unit 24 which reads printing results generated by the print unit 12, and a paper output unit 26 which outputs the printed recording paper (printed object) to the outside.

In FIG. 1, a magazine for rolled paper (continuous paper) is shown as an example of the paper supply unit 18; however, more magazines with paper differences such as paper width and quality may be jointly provided. Paper may also be supplied using cassettes containing cut sheets of paper loaded in layers, and these cassettes may be used jointly or in lieu of the magazine for rolled paper. In the case of an apparatus constitution using rolled paper, as shown in FIG. 1, a cutter 28 is provided, and the rolled paper is cut into the desired size by this cutter 28. The cutter 28 is constituted by a stationary blade 28A having a length which is equal to or greater than the width of the conveyance path for the recording paper 16, and a round blade 28B which moves along the stationary blade 28A. When cut paper is used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1. The suction chamber 34 provides suction with a fan 35 to generate a negative pressure, and the recording paper 16 on the belt is held by suction.

The belt 33 is driven in the clockwise direction in FIG. 1 by the motive force of a motor (not shown) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
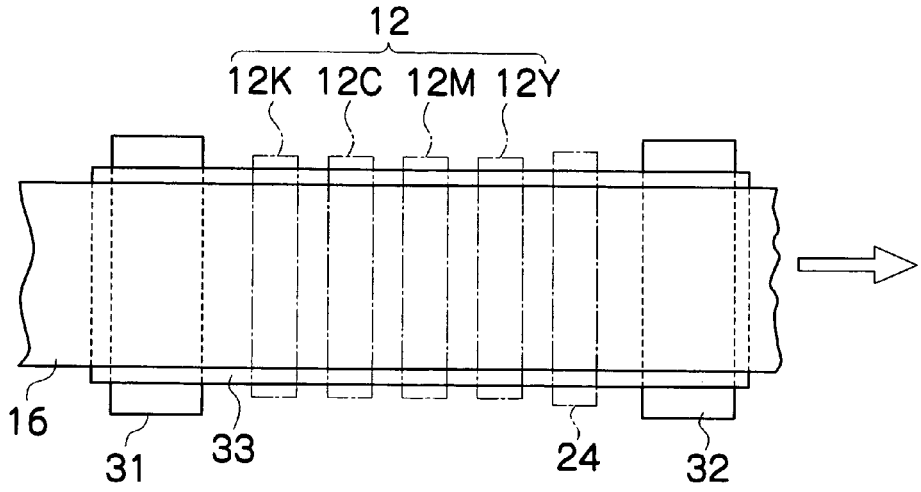
FIG. 2 is a principal plan view of the periphery of a print unit in the inkjet recording apparatus shown in FIG. 1.

The print unit 12 forms a so-called full-line head (see FIG. 2) in which line heads having a length which corresponds to the maximum paper width are disposed in an orthogonal direction (the main scanning direction) to the paper conveyance direction (the sub-scanning direction). As shown in FIG. 2, each print head 12K, 12C, 12M, 12Y is constituted as a line head in which a plurality of ink ejection ports (nozzles) are arranged over a length which exceeds at least one side of the maximum sized recording paper 16 that can be used in the inkjet recording apparatus 10.

The print heads 12K, 12C, 12M, 12Y corresponding to the ink colors are disposed in order of black (K), cyan (C), magenta (M), and yellow (Y) from the upstream side (the left side in FIG. 1) in the conveyance direction of the recording paper 16 (the paper conveyance direction). A color image can be formed on the recording paper 16 by depositing colored ink thereon from the respective print heads 12K, 12C, 12M, 12Y while conveying the recording paper 16.

According to the print unit 12, in which a full line head covering the entire paper width is provided for each ink color, an image can be recorded on the entire surface of the recording paper 16 by performing an operation to move the recording paper 16 relative to the print unit 12 in the paper conveyance direction (sub-scanning direction) a single time (i.e. with one sub-scan). In so doing, it is possible to achieve a higher print speed than that of a shuttle head, in which the print head performs a reciprocating movement in an orthogonal direction (the main scanning direction) to the paper conveyance direction. As a result, an improvement in productivity can be achieved.

Here, the terms "main scanning direction" and "sub-scanning direction" are used with the following meaning. When the nozzles are driven in a full line head having a nozzle array corresponding to the entire width of the recording paper, an operation such as (1) driving all of the nozzles simultaneously, (2) driving the nozzles in sequence from one nozzle to another, or (3) dividing the nozzles into blocks and driving the nozzles in block sequence from one block to another, is performed. Main scanning is defined as performing one of these operations such that one line (a line constituted by a single dot array or a line constituted by a plurality of dot arrays) is printed in the width direction of the paper (the orthogonal direction to the recording paper conveyance direction). The direction of the line (the lengthwise direction of a strip-form area) recorded as a result of the main scan is known as the main scanning direction.

Meanwhile, sub-scanning is defined as printing the line (a line constituted by a single dot array or a line constituted by a plurality of dot arrays) formed by the main scan described above repeatedly by moving the full line head and recording paper relative to each other as described above. The direction in which this sub-scan is performed is known as the sub-scanning direction. In short, the recording paper conveyance direction is the sub-scanning direction, and the orthogonal direction thereto is the main scanning direction.

Although the configuration with the KCMY four standard colors is described in the present embodiment, combinations of the ink colors and the number of colors are not limited to those. Light inks or dark inks can be added as required. For example, a configuration is possible in which print heads for ejecting light-colored inks such as light cyan and light magenta are added.

As shown in FIG. 1, the ink storing and loading unit 14 comprises tanks storing colored inks corresponding to the print heads 12K, 12C, 12M, 12Y. Each tank communicates with its print head 12K, 12C, 12M, 12Y via a pipe (not shown). The ink storing and loading unit 14 further comprises a notification device (a display device, warning sound generating device or the like) for providing notification of a low remaining ink amount, and a mechanism for preventing situations in which the wrong ink color is loaded.

The print determination unit 24 has an image sensor (a line sensor) for capturing an image of the ink-droplet deposition result of the printing unit 12, and functions as a device to check for ejection defects such as clogs of the nozzles in the printing unit 12 from the ink-droplet deposition results evaluated by the image sensor.

The print determination unit 24 of the present embodiment is configured with at least a line sensor having rows of photoelectric transducing elements with a width that is greater than the ink-droplet ejection width (image recording width) of the print heads 12K, 12C, 12M, 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern printed by the print heads 12K, 12C, 12M, 12Y of the colors, and detects ink ejection from the heads. The ejection determinations comprise the presence or absence of ejection, dot size measurement, measurement of the dot landing position, and so on.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown, the paper output unit 26A for the target prints is provided with a sorter for collecting prints according to print orders.

Figure 3:
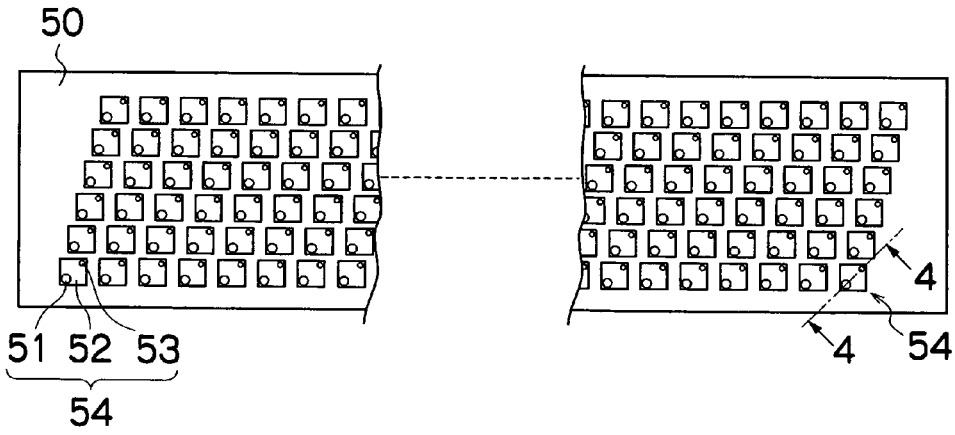
FIG. 3 is a projected plan view showing a constitutional example of a print head.

Next, the print head (liquid ejection unit) will be described. The print heads 12K, 12C, 12M, 12Y provided for the ink colors have a common structure, and hence in the following description, the print heads will be represented by the reference numeral 50. FIG. 3 shows a projected plan view of the print head 50.

As shown in FIG. 3, in the print head 50 of this embodiment, pressure chamber units 54 constituted by a nozzle 51 which ejects ink in the form of liquid droplets, a pressure chamber 52 which applies pressure to the ink during ink ejection, and an ink supply port 53 which supplies ink to the pressure chamber 52 are arranged in a two-dimensional, staggered matrix form so that the nozzles 51 are provided at a high density.

As shown in FIG. 3, each pressure chamber 52 has a substantially square form when seen from above. The nozzle 51 is formed at one end of the diagonal, and the ink supply port 53 is provided at the other end.

Figure 4:
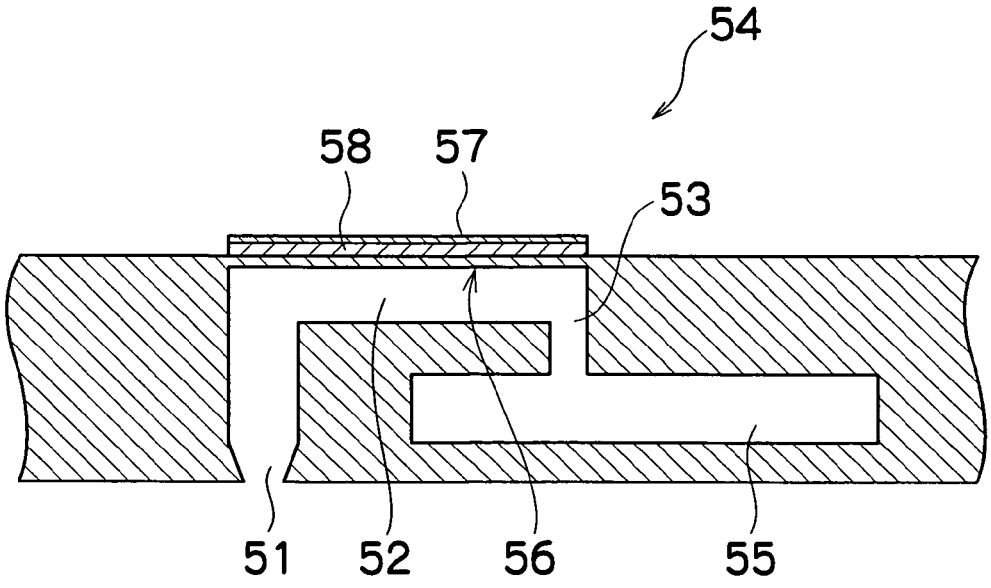
FIG. 4 is a sectional view along a line 4-4 in FIG. 3, and shows a constitutional example of a pressure chamber in the print head.

A sectional view along a line 4-4 in FIG. 3 is shown in FIG. 4. As shown in FIG. 4, the pressure chamber unit 54 is formed by the pressure chamber 52 which communicates with the nozzle 51 for ejecting the ink. A common flow passage 55 for supplying ink to the pressure chamber 52 communicates with the pressure chamber 52 via the supply port 53. One surface of the pressure chamber 52 (the ceiling face in FIG. 3) is constituted by a diaphragm 56, and a piezoelectric element 58 which applies pressure to the diaphragm 56 to cause the diaphragm 56 to deform is joined to the top of the diaphragm 56. An individual electrode 57 is provided on the upper face of the piezoelectric element 58. The diaphragm 56 also serves as a common electrode.

The piezoelectric element 58 is sandwiched by the common electrode (diaphragm 56) and individual electrode 57, and deformed when a drive voltage is applied to these two electrodes 56, 57. The diaphragm 56 is pressed by the deformation of the piezoelectric element 58, causing the volume of the pressure chamber 52 to decrease such that ink is ejected from the nozzle 51. When application of the voltage to the two electrodes 56, 57 is released, the piezoelectric element 58 returns to normal, the pressure chamber 52 returns to its original volume, and new ink is supplied to the pressure chamber 52 from the head common flow passage 55 via the supply port 53.

Figure 5:
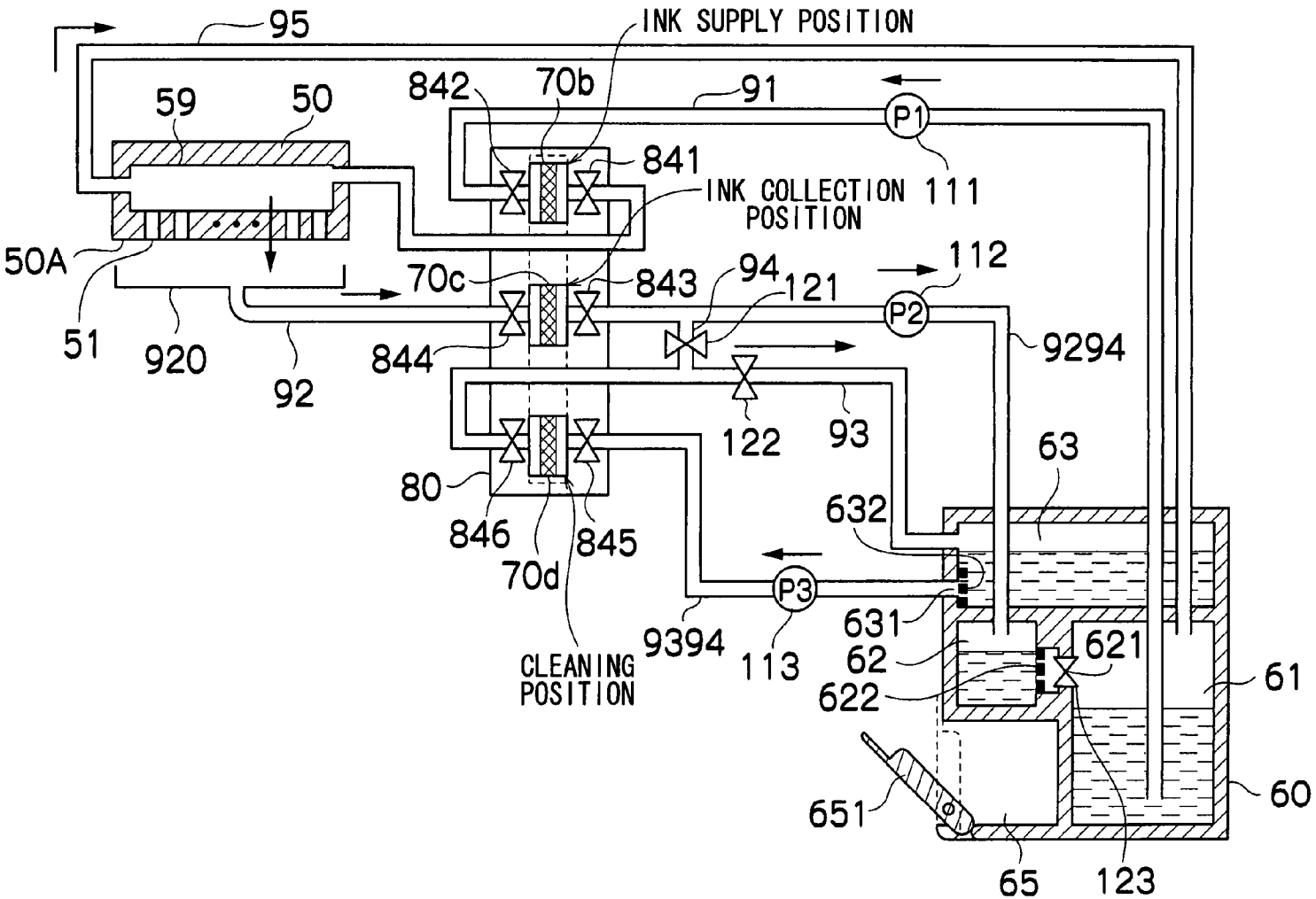
FIG. 5 is a constitutional diagram showing a specific example of an ink circulation system in the inkjet recording apparatus.

FIG. 5 is a schematic diagram showing the constitution of an ink circulation system in the inkjet recording apparatus 10.

In FIG. 5, for ease of illustration, the common flow passage 55, supply port 53, and pressure chamber 52 shown inside the print head 50 in FIG. 4 are illustrated together as a single square 59.

In the inkjet recording apparatus 10 shown in FIG. 5, a cap 920 is provided as a member for preventing drying of the nozzle 51 of the print head 50, removing viscous ink from the vicinity of the nozzle 51, and taking in ink from the print head 50 (more specifically, from the nozzle 51). During printing or standby, a purging operation is performed to eject the viscous ink in the vicinity of the nozzle 51 forcibly toward the cap 920 from the print head 50 (a purging operation is also known as "preliminary ejection", "dry ejection", and so on). Also, the cap 920 is placed on the print head 50 to suction ink (ink that is intermixed with air bubbles) from inside the print head 50 to the cap 920 side. This suction operation toward the cap 920 side is performed during loading of an ink cartridge 60, or when usage is resumed after a long stoppage, to suction ink from the interior of the print head 50 to the cap 920 side. More specifically, when the bubbles intermixed in the ink inside the print head 50 expand or the viscosity of the ink in the nozzle 51 rises above a certain level so that the ink cannot be ejected by a purging operation, the cap 920 is attached tightly to the print head 50 and a suction operation is performed. Thus the unnecessary ink in the print head 50 can be transferred to the cap 920 side. The ink that is transferred into the cap 920 from the print head 50 by a purging operation or suction operation is reused as ink to be ejected from the print head 50.

The ink that is transferred into the cap 920 from the print head 50 contains foreign matter such as lumps of viscous, hardened ink (viscous ink lumps) and paper particles. Therefore, to prevent defective ejection by the print head 50 and perform high-quality printing, the ink must be supplied to the print head 50 after removing such foreign matter. A constitution for removing foreign matter from the ink and then circulating the ink will now be described in detail.

The ink cartridge 60 is a (detachable) unit that can be attached to and detached from the main body of the inkjet recording apparatus 10, and constitutes the ink storing and loading unit 14 shown in FIG. 1. The ink cartridge 60 is defined by an ink supply chamber 61 which stores ink to be supplied to the print head 50, a collected ink chamber 62 which temporarily stores ink collected from the print head 50 via the cap 920, a diluting fluid chamber 63 which stores a diluting fluid for diluting the ink in the collected ink chamber 62, and a discarded filter storage chamber 65 which stores used filters 70. In this embodiment, the diluting fluid also serves as a cleaning fluid for removing foreign matter accumulated in the filter 70, and the diluting fluid chamber 63 also serves as a cleaning fluid chamber 63 storing the cleaning fluid.

A pipe extending from the ink supply chamber 61, via a first pump 111 (ink supply pump), to the print head 50 serves as an ink supply flow passage 91. The ink stored in the ink supply chamber 61 is supplied to the print head 50 through the ink supply flow passage 91 when the first pump 111 (ink supply pump) is driven, and then ejected from the nozzles 51 formed in the nozzle face 50A of the print head 50. Excess ink that is not ejected from the nozzle 51 is circulated to the ink supply chamber 61 through a non-ejected ink flow passage 95 (which leads directly to the ink supply chamber 61 from the print head 50 without passing through the cap 920) except in cases where the excess ink is transferred into the cap 920.

A pipe extending from the cap 920 to the collected ink chamber 62 via a second pump 112 (ink collection pump) serves as an ink collection flow passage 92. The ink collection flow passage 92 includes a common flow passage 9294 that is shared with a dilution flow passage 94 to be described below. Ink that is ejected from the print head 50 toward the cap 920 during a purging operation or the like, or ink that is suctioned into the cap 920 from the print head 50, is collected in the collected ink chamber 62 through the ink collection flow passage 92 when the second pump 112 (ink collection pump) is driven. The ink collected in the collected ink chamber 62 is diluted using the diluting fluid of the diluting fluid chamber 63 in accordance with the ink characteristics (the concentration, viscosity, specific gravity, and so on of the ink), and then dropped into the ink supply chamber 61 through a connecting portion 621 formed between the collected ink chamber 62 and ink supply chamber 61. In other words, the ink is reduced to characteristics which enable the ink to be ejected by the print head 50, and then returned to the ink supply chamber 61.

A pipe which extends from the diluting fluid chamber 63 (also serving as the cleaning fluid chamber), passes a third pump 113, cleans the filter 70 in a filter cleaning position, and then returns to the diluting fluid chamber 63 serves as a cleaning flow passage 93. A pipe extending from the diluting fluid chamber 63 to the collected ink chamber 62 via the third pump 113 serves as the dilution flow passage 94. The cleaning flow passage 93 includes a common flow passage 9394 that is shared with the dilution flow passage 94, and the dilution flow passage 94 includes a common flow passage 9394 that is shared with the cleaning flow passage 93 and the common flow passage 9294 that is shared with the ink collection flow passage 92. When a dilution flow passage valve 121 (valve 1) is open and a cleaning flow passage valve 122 (valve 2) is closed, the diluting fluid stored in the diluting fluid chamber 63 is introduced into the collected ink chamber 62 through the dilution flow passage 94 by driving the third pump 113. As a result, the ink in the collected ink chamber 62 is diluted. Conversely, when the dilution flow passage valve 121 (valve 1) is closed and the cleaning flow passage valve (valve 2) is open, the diluting fluid (also serving as cleaning fluid) stored in the diluting fluid chamber 63 (also serving as the cleaning fluid chamber) is circulated back to the diluting fluid chamber 63 through the cleaning flow passage 93 by driving the third pump 113, and thus the diluting fluid serves as cleaning fluid for cleaning the filter (70*d* in FIG. 5) disposed in the filter cleaning position. By means of this diluting fluid (cleaning fluid) flow, accumulated foreign matter is removed from the filter 70.

A filter 70 (70*b*, 70*c*, 70*d*) is connected removably to each of the ink supply flow passage 91, ink collection flow passage 92, and cleaning flow passage 93. The filter 70*b* connected to the ink supply flow passage 91 transmits ink that is to be supplied to the print head 50 from the ink supply chamber 61, and thereby traps foreign matter contained in the ink. The filter 70*c* connected to the ink collection flow passage 92 transmits the ink that is to be collected in the collected ink chamber 62 from the cap 920, and thereby traps foreign matter contained in the ink. The filter 70*d* connected to the cleaning flow passage 93 is cleaned of foreign matter by the diluting fluid (cleaning fluid) that flows through the cleaning flow passage 93. The foreign matter removed from the filter 70*d* flows into the diluting fluid chamber 63 (cleaning fluid chamber) together with the diluting fluid.

In the inkjet recording apparatus 10 of this embodiment, the flow passages, the liquid chambers in the ink cartridge 60, and so on serve dual purposes. To facilitate understanding of the constitution of this ink circulation system, the logical constitution thereof is shown in FIG. 6.

Figure 6:
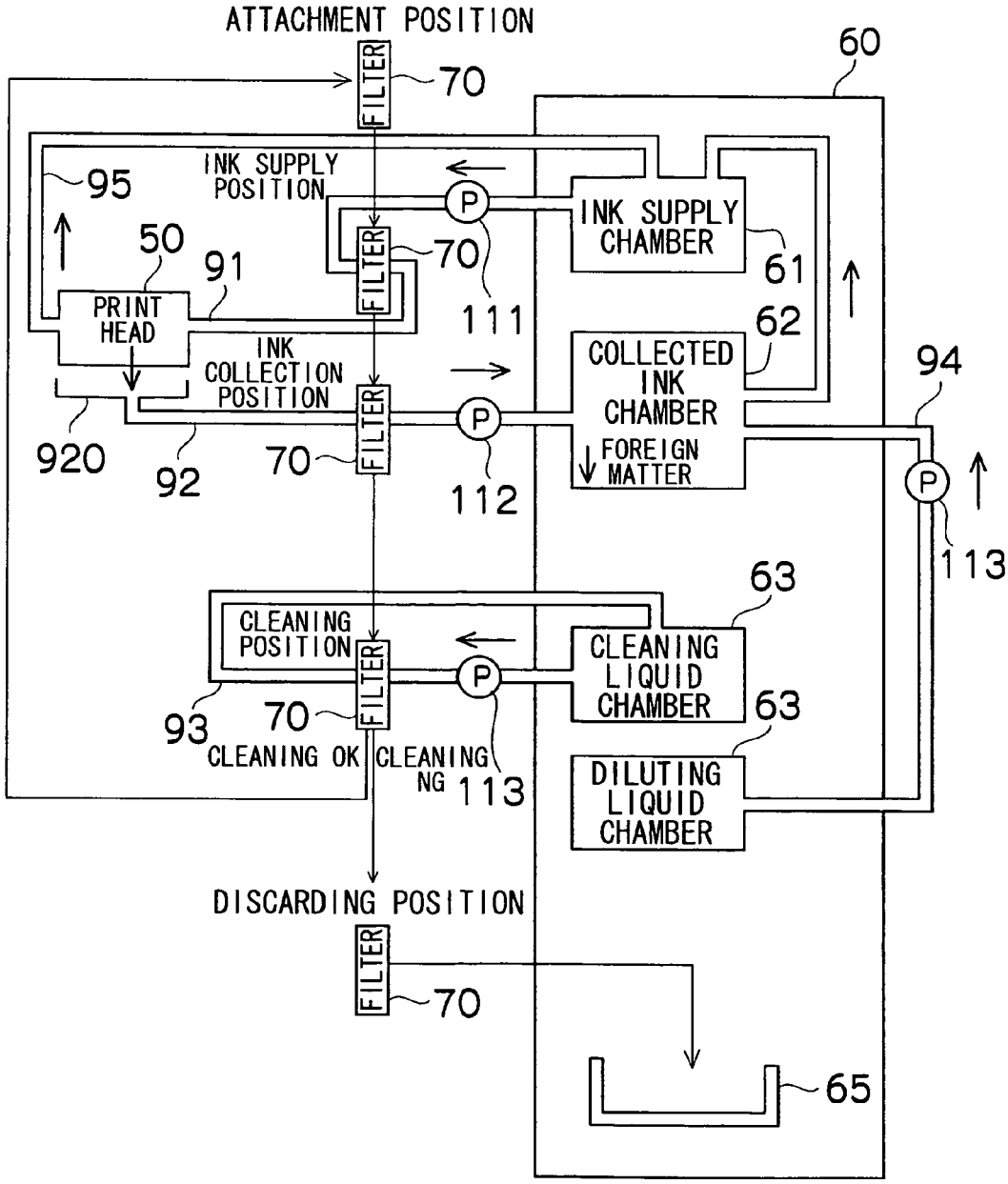
FIG. 6 is an illustrative view showing a logical example of the ink circulation system in the inkjet recording apparatus.

As shown in FIG. 6, in this embodiment the same filter 70 moves in sequence from an attachment position for attaching the filter 70, an ink supply position connected to the ink supply flow passage 91, an ink collection position connected to the ink collection flow passage 92, and a cleaning position connected to the cleaning flow passage 93. Once the foreign matter in the filter 70 has been removed sufficiently by cleaning, the filter 70 is moved again in sequence from the attachment position, to the ink supply position, ink collection position, and cleaning position. In other words, the filter 70 is switched repeatedly from a non-connected state (stand-by state), a state of connection to the ink supply flow passage 91, a state of connection to the ink collection flow passage 92, and a state of connection to the cleaning flow passage 93, in sequence, and hence the filter 70 is reused. When it becomes impossible to remove foreign matter sufficiently from the filter 70 through cleaning, the filter 70 is output to the discarded filter storage chamber 65 in the ink cartridge 60.

A folder 80 shown in FIG. 5 holds a plurality of the filters 70, and switches the positions of the filters 70 so that the filters 70 are connected to the plurality of flow passages in sequence. This folder 80 is constituted principally by a rotary unit 81 shown in FIGS. 7 and 8, and a fixed unit 82 shown in FIGS. 9, 10, and 11.

Figure 7:
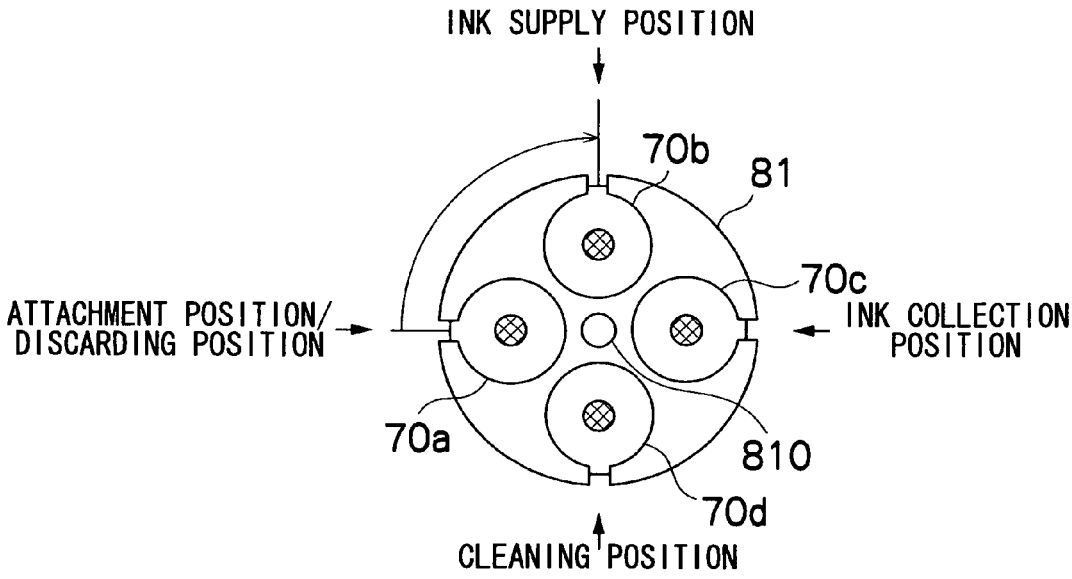
FIG. 7 is a front view showing an example of a rotary unit of a folder in the inkjet recording apparatus.
Figure 8:
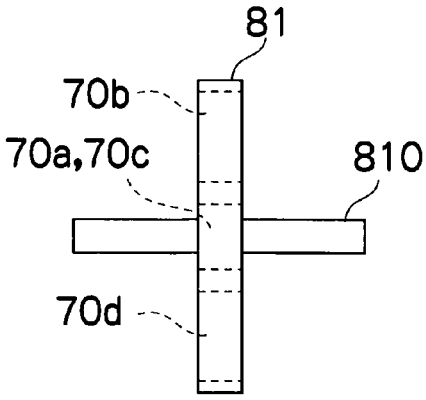
FIG. 8 is a side view showing an example of the rotary unit of the folder in the inkjet recording apparatus.

FIG. 7 shows a front view of the rotary unit 81 of the folder 80, and FIG. 8 shows a side view thereof. In FIGS. 7 and 8, the rotary unit 81 of the folder holds the plurality of filters 70 (70*a*, 70*b*, 70*c*, 70*d*) removably, and rotates about the axis of a rotating shaft 810. The rotating shaft 810 is driven to rotate by a drive unit (not shown). When the rotary unit 81 rotates in this manner, each filter 70 switches position in sequence from the attachment position, to the ink supply position, ink collection position, and cleaning position, and then returns to the attachment position, from which the filter 70 again switches position in sequence to the ink supply position, ink collection position, and cleaning position. Each filter 70 continues to rotate circumferentially about the rotating shaft 810, passing through each position, until the filter is judged to be a discarded filter at the attachment position, which also serves as a discarding position.

The filter 70 can be attached to the folder 80 in the attachment position. The filter 70*a* disposed in the attachment position is not connected to any of the flow passages. In this embodiment, the attachment position also serves as the discarding position, and hence the filter 70 can be removed from the folder 80 in this position. In the ink supply position, the filter 70 is connected to the ink supply flow passage 91. The filter 70*b* disposed in the ink supply position removes foreign matter contained in the ink that is supplied to the print head 50 from the ink supply chamber 61. In the ink collection position, the filter 70 is connected to the ink collection flow passage 92. The filter 70*c* disposed in the ink collection position removes foreign matter contained in the ink that is collected in the collected ink chamber 62 from the cap 920. In the cleaning position, the filter 70 is connected to the cleaning flow passage 93. Foreign matter is removed from the filter 70*d* disposed in the cleaning position by diluting liquid that is suctioned from the diluting liquid chamber 63 by driving the third pump 113, and thus serves as cleaning fluid.

Figure 9:
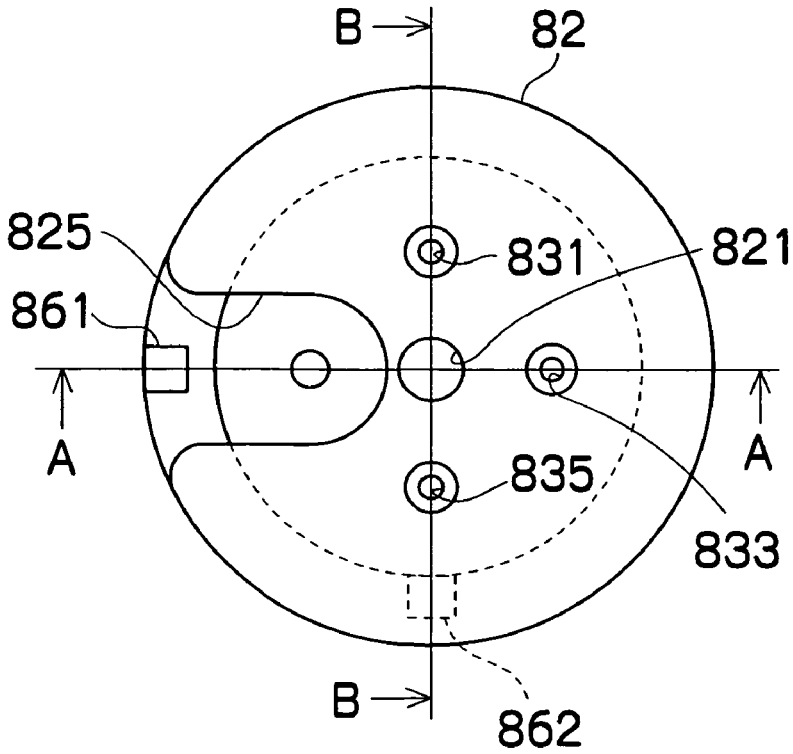
FIG. 9 is a front view showing an example of a fixed unit of the folder in the inkjet recording apparatus.
Figure 10:
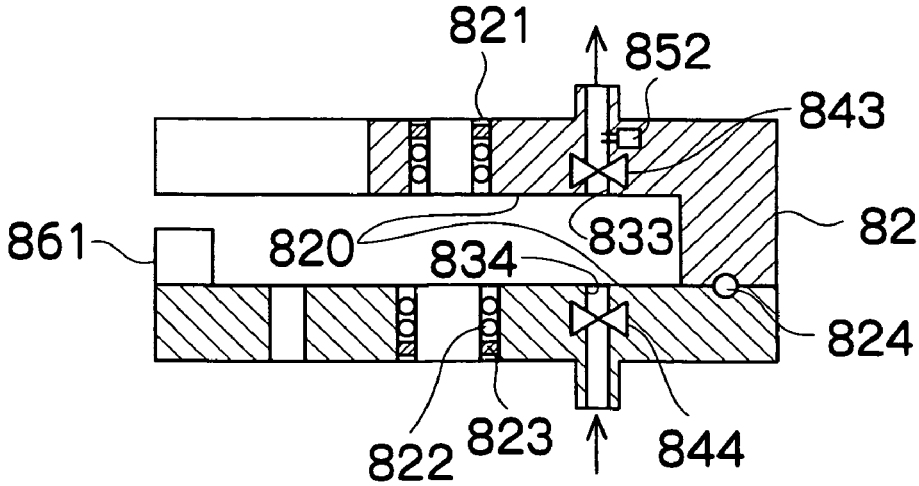
FIG. 10 is a sectional view along a line A-A in FIG. 9, and shows an example of the fixed unit of the folder in the inkjet recording apparatus.
Figure 11:
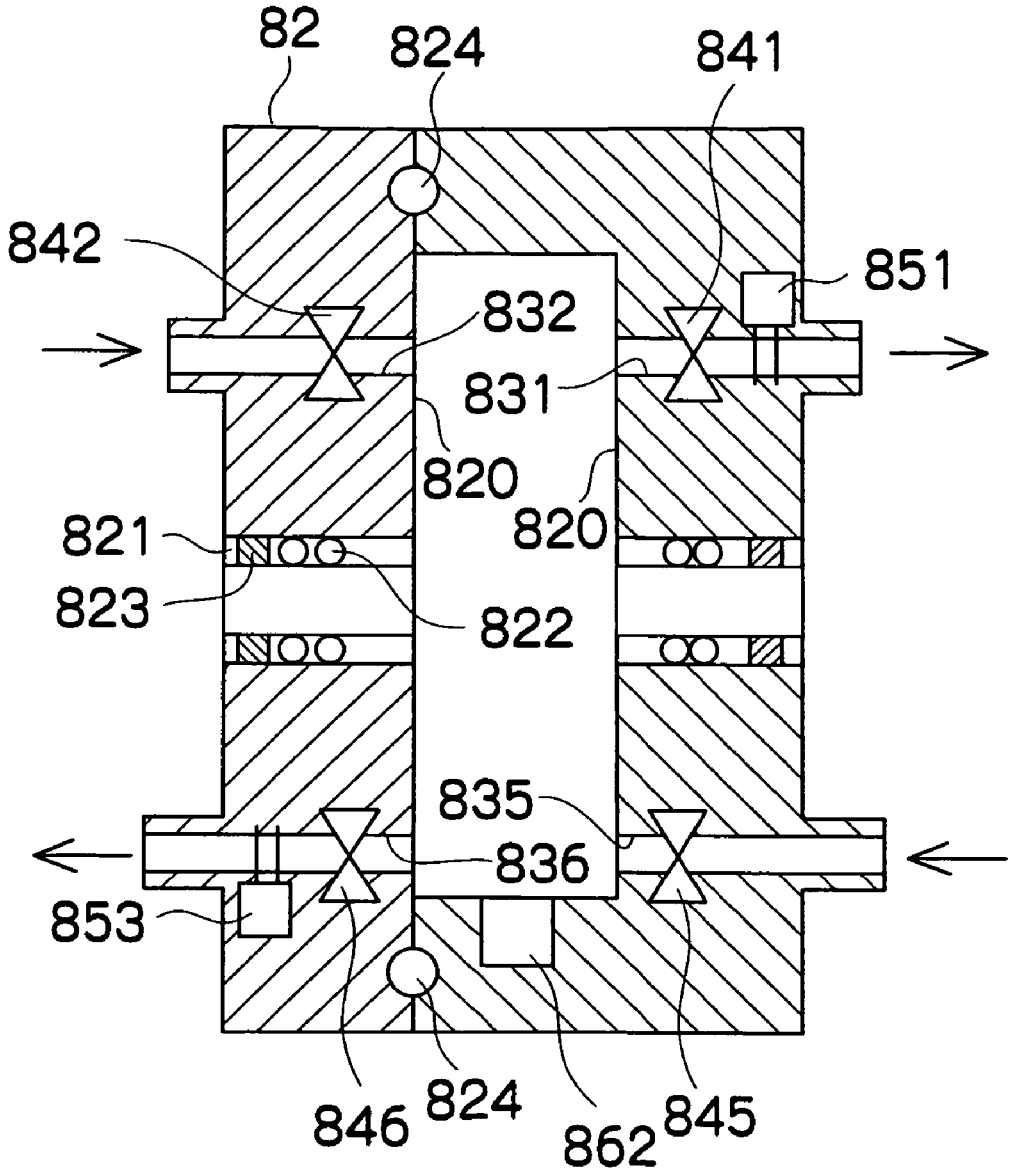
FIG. 11 is a sectional view along a line B-B in FIG. 9, and shows an example of the fixed unit of the folder in the inkjet recording apparatus.

A front view of the fixed unit 82 of the folder 80 is shown in FIG. 9, an A-A sectional view thereof is shown in FIG. 10, and a B-B sectional view thereof is shown in FIG. 11.

In FIG. 11, a bearing unit 821 comprising a bearing 822 is formed in the fixed unit 82 of the folder 80. The fixed unit 82 surrounds the rotary unit 81 shown in FIGS. 7 and 8, and supports the rotary unit 81 rotatably by means of the bearing unit 821 via the rotating shaft 810 of the rotary unit 81.

The fixed unit 82 is also formed with through holes (first through hole 831, second through hole 832) constituting a part of the ink supply flow passage 91, through holes (third through hole 833, fourth through hole 834) constituting a part of the ink collection flow passage 92, and through holes (fifth through hole 835, sixth through hole 836) constituting a part of the cleaning flow passage 93. Furthermore, the through holes 831 to 836 are provided with opening/closing valves 841, 842, 843, 844, 845, 846 (through hole opening/closing valves), respectively. More specifically, in the fixed unit 82 the opening/closing valves 841 to 846 are provided upstream and downstream of the filter 70*b* in the ink supply position, the filter 70*c* in the ink collection position, and the filter 70*d* in the cleaning position. When the rotary unit 81 of the folder 80 rotates, or in other words when the filters 70 are circulated, the opening/closing valves 841 to 846 of the through holes 831 to 836 are all set in a closed state to prevent liquid leakage. On the other hand, when the rotary unit 81 of the folder 80 is stationary, or in other words when the filters 70 are connected to the flow passages, the opening/closing valves 841 to 846 of the through holes 831 to 836 are all set in an open state so that the ink or diluting fluid (cleaning fluid) in the flow passages can flow.

More specifically, when the filter 70*b* positioned in the ink supply position is connected to the first through hole 831 and second through hole 832 and the opening/closing valves 841, 842 of these through holes are open, by driving the first pump 111, foreign matter is removed from the ink supplied from the ink supply chamber 61 by the filter 70*b* in the ink supply position, whereupon the ink is supplied to the print head 50. When the filter 70*c* positioned in the ink collection position is connected to the third through hole 833 and fourth through hole 834 and the opening/closing valves 843, 844 of these through holes are open, by driving the second pump 112, foreign matter is removed from the ink that is drawn into the cap 920 by the filter 70*c* in the ink collection position, whereupon the ink is collected in the collected ink chamber 62. When the filter 70*d* positioned in the cleaning position is connected to the fifth through hole 835 and sixth through hole 836 and the opening/closing valves 845, 846 of these through holes are open, by driving the third pump 113, the foreign matter that has accumulated in the filter 70*d* is removed from the filter 70*d* by the flow of diluting fluid (cleaning fluid) suctioned from the diluting fluid chamber 63 (cleaning fluid chamber). The foreign matter then flows into and settles in the diluting fluid chamber 63.

To prevent liquid leakage in this embodiment, as well as providing the opening/closing valves 841 to 846 for the through holes 831 to 836, measures such as providing a seal 823 on the bearing unit 821 and providing an O-ring 824 on the joint face between the members constituting the fixed unit 82 are taken.

As shown in FIGS. 10 and 11, flow velocity sensors 851, 852, 853 (flow passage resistance measurement devices) which measure the flow velocity of the flow passages are provided in the downstream side through holes 831, 833, 836, respectively, of the fixed unit 82. More specifically, a first flow velocity sensor 851 is disposed in the first through hole 831 on the downstream side of the filter 70*b* in the ink supply position to measure a flow velocity V1 of the ink supply flow passage 91, a second flow velocity sensor 852 is disposed in the third through hole 833 on the downstream side of the filter 70*c* in the ink collection position to measure a flow velocity V2 of the ink collection flow passage 92, and a third flow velocity sensor 853 is annexed to the sixth through hole 836 on the downstream side of the filter 70*d* in the cleaning position to measure a flow velocity V3 of the cleaning flow passage 93.

When the flow velocity V1 of the ink supply flow passage 91 is measured to be equal to or lower than a predetermined threshold by the first flow velocity sensor 851, or when the flow velocity V2 of the ink collection flow passage 92 is measured to be equal to or lower than a predetermined threshold by the second flow velocity sensor 852, it is determined that at least a predetermined amount of foreign matter has accumulated in the filter 70, and hence the filters 70 are circulated. More specifically, when the flow velocity V1 of the ink supply flow passage 91 reaches or falls below "k1× initial flow velocity" in relation to the flow velocity when there is no foreign matter (the initial flow velocity), or when the flow velocity V2 of the ink collection flow passage 92 reaches or falls below "k2×initial flow velocity" in relation to the flow velocity when there is no foreign matter (the initial flow velocity), the filters 70 are circulated by rotating the rotary unit 81 of the folder.

When the flow velocity V3 of the cleaning flow passage 93 is measured to be greater than a predetermined threshold by the third flow velocity sensor 853, it is determined that cleaning of the filter 70 has been performed successfully. More specifically, it is determined that cleaning of the filter 70 has been performed successfully when the flow velocity V3 of the cleaning flow passage 93 increases above "k3×initial flow velocity" after a predetermined cleaning operation, and that cleaning of the filter 70 has failed when the flow velocity V3 of the cleaning flow passage 93 is equal to or less than "k3× initial flow velocity".

Here, the coefficients k1, k2, k3 are numerical values between 0 and 1.00. The magnitude relation therebetween is k3>k1>k2. For example, k1=0.90 (corresponding to 10% below the initial flow velocity of the ink supply flow passage 91), k2=0.80 (corresponding to 20% below the initial flow velocity of the ink collection flow passage 92), and k3=0.95 (corresponding to 5% below the initial flow velocity of the cleaning flow passage 93).

Figure 12A:
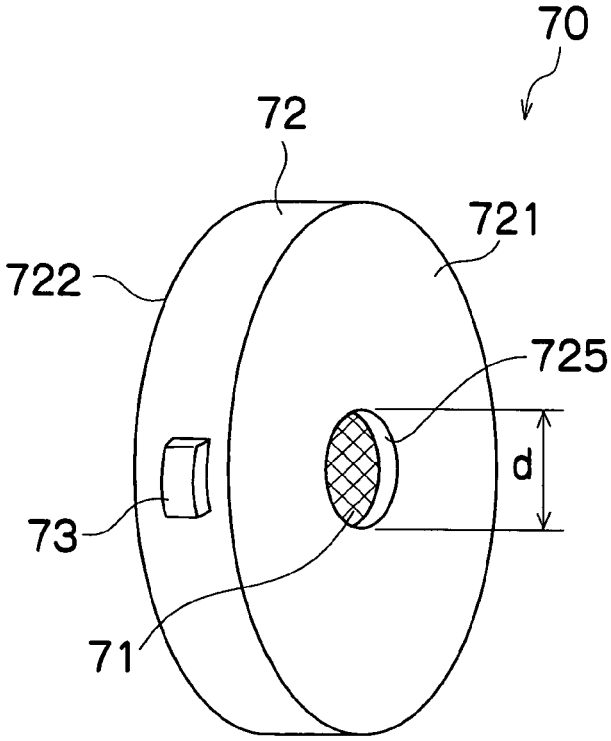
FIGS. 12A and 12B are perspective views showing an example of a filter.
Figure 12B:
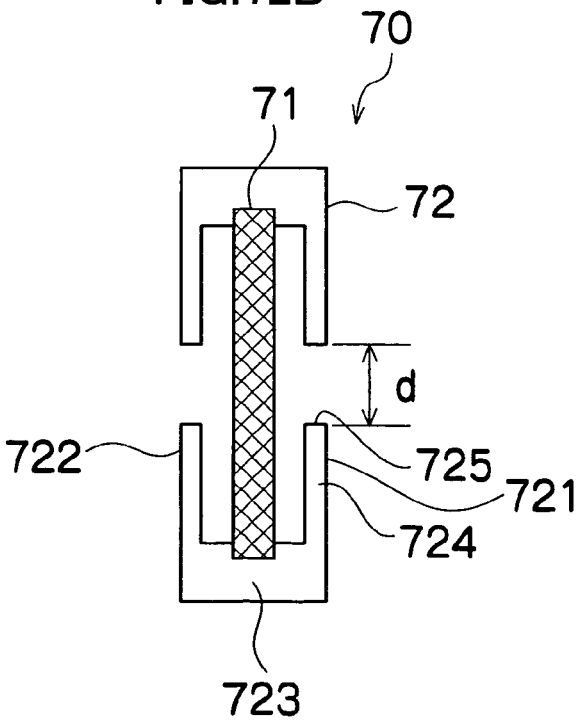

FIG. 12A shows a perspective view of the filter 70, and FIG. 12B shows a sectional view thereof. The filter 70 is constituted principally by a mesh material 71 which transmits ink (or diluting fluid) and traps foreign matter such as viscous ink lumps and paper particles, and a frame body 72 attached to the mesh material 71.

In this embodiment, the outer form of the mesh material 71 and frame body 72 is disk-form.

As shown in FIG. 12B in particular, the frame body 72 comprises a gripping portion 723 constituted by an annular plate, which grips the outer periphery of the mesh material 71, and an edge portion 724 forming two end faces 721, 722, which curves inward at a right angle from the gripping portion 723 and thereby surrounds the mesh material 71.

The center part of the two end faces 721 and 722 is formed with an opening portion 725 through which liquid can pass. A diameter d of the opening portion 725 is set larger than the diameter of the through holes 831, 832, 833, 834, 835, 836 in the fixed unit 82, but considerably smaller than the diameter of a human finger so that a human finger cannot be inserted. In other words, the opening portion 725 is formed to transmit liquid, but also to prevent situations in which the filtering function of the filter 70 is reduced when a human finger touches the mesh material 71 so that oil from the finger adheres to the mesh material 71.

As shown in FIG. 12B, the sectional form of the frame body 72 appears as two "C" shapes opposed to each other. Hence, when liquid remains in the interior of the frame body 72 even after the pump is driven to ensure that no liquid remains, the remaining liquid is held by the edge portion 724 and does not leak out.

When the two end faces 721, 722 of the frame body 72 contact an inner peripheral wall 820 of the fixed unit 82 of the folder 80, the filter 70 is connected to the through holes (831 and 832, 833 and 834, 835 and 836) of the fixed unit 82 of the folder 80.

The fixed unit 82 is also provided with a notch portion 825 in the attachment position for attaching and removing the filter 70.

An IC tag (also known as RFID: Radio Frequency Identification) 73, which is capable of writing and reading information in a non-contact state, is attached to the outer peripheral surface of the frame body 72 of the filter 70. Further, as shown in FIGS. 9 and 10, the fixed unit 82 of the folder 80 is provided with an IC tag reader 861 in the attachment position, and an IC tag writer/reader 862 in the cleaning position.

Identification information (or a serial number) indicating the type and so on of the filter 70 is read from the IC tag 73 of the filter 70 by the IC tag reader 861 provided in the attachment position, and hence it is possible to determine whether or not the filter 70 is appropriate for use in the inkjet recording apparatus 10. When it is determined on the basis of the identification information that an inappropriate filter 70 is attached, the inkjet recording apparatus 10 issues a warning using a buzzer, display, or similar means.

Usage history information (the filter usage frequency, number of cleaning operations, flow passage flow velocity history, and so on) of the filter 70 is created by the IC tag writer/reader 862 provided in the cleaning position, and recorded on the IC tag 73. The recorded usage history information is then read from the IC tag 73 by the IC tag writer/reader 862 to determine whether to store the filter 70 in the cleaning position in the discarded filter storage chamber 65, or to reconnect the filter 70 to the ink supply flow passage 91 and ink collection flow passage 92 for reuse. The IC tag writer/reader 862 in the cleaning position may be omitted, and instead, the usage condition of the filter 70 may be recorded in the memory (not shown) of the apparatus main body in association with the identification information of the filter 70.

Furthermore, in this embodiment a case in which the IC tag 73 is attached to the filter 70 has been described, but the present invention is not limited to an aspect in which the IC tag 73 is attached to the filter 70, and the identification information of the filter 70 may be read using another method. For example, the identification information of the filter 70 may be read using electromagnetic reading or optical reading.

Figure 13A:
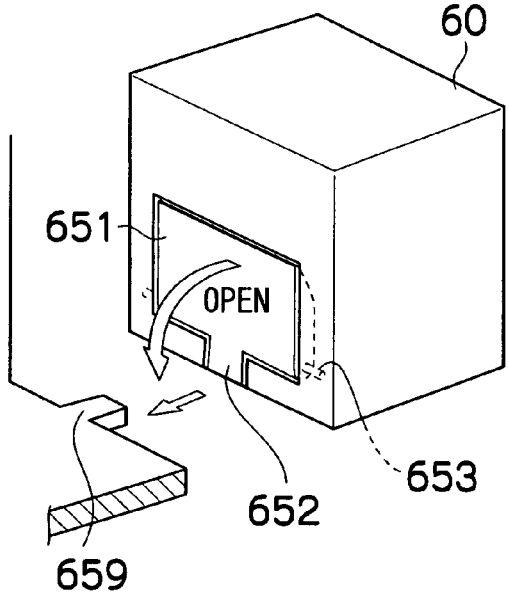
FIGS. 13A and 13B are illustrative views used to illustrate the opening and closing of a door of a discarded filter storage chamber provided in an ink cartridge.
Figure 13B:
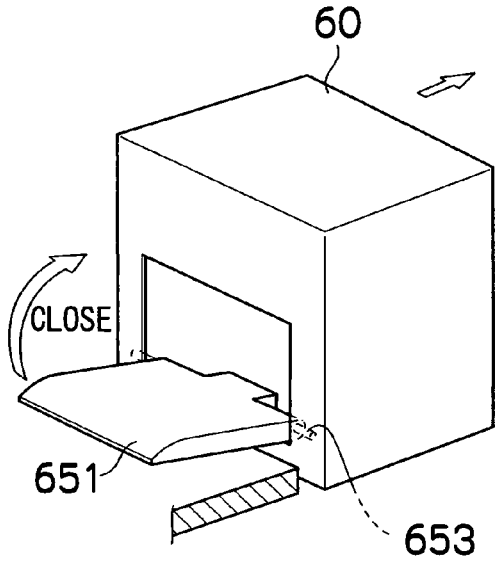

Next, using FIGS. 13A and 13B, the opening and closing of a door 651 (opening/closing portion) of the discarded filter storage chamber 65, which is formed in the ink cartridge 60, will be described. As shown in FIG. 13A, the door 651 is in a closed state before the ink cartridge 60 is attached to the main body of the inkjet recording apparatus 10. When the ink cartridge 60 is attached to the main body of the inkjet recording apparatus 10, the door 651 enters an open state as shown in FIG. 13B, and when the ink cartridge 60 is detached from the main body of the inkjet recording apparatus 10, the door 651 is closed.

More specifically, the door 651 is held in a closed state by the urging of an urging device (a torsion spring, plate spring, or similar, for example) (not shown). When a contact portion 652 constituting a part of the door 651 contacts a contact partner (protrusion 659) on the main body side of the inkjet recording apparatus 10, the door 651 rotates using a pin 653 on the door 651 side as a shaft, and thus the door 651 enters an open state. When the ink cartridge 60 is detached from the main body of the inkjet recording apparatus 10 so that the contact between the contact portion 652 of the door 651 and the contact partner (protrusion 659) on the main body side of the inkjet recording apparatus 10 is released, the urging of the urging device (not shown) causes the door 651 to rotate about the pin 653 on the door 651 side such that the door 651 enters a closed state.

Figure 14:
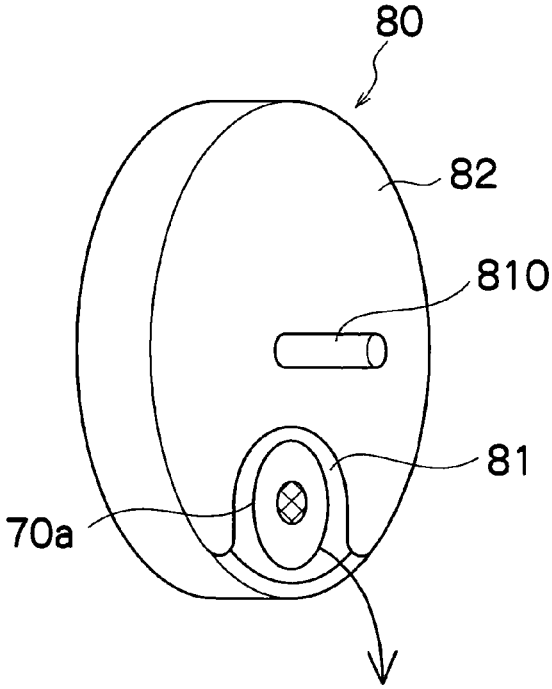
FIG. 14 is an illustrative view used to illustrate filter disposal.

The inkjet recording apparatus 10 is also provided with a filter discarding unit (not shown) which detaches unnecessary filters 70 from the rotary unit 81 of the folder 80 and discards them in the discarded filter storage chamber 65 of the ink cartridge 60. The filter 70*a* disposed in the attachment position (also serving as a discarding position) is dropped into the discarded filter storage chamber 65 as shown by the arrow in FIG. 14.

Figure 15:
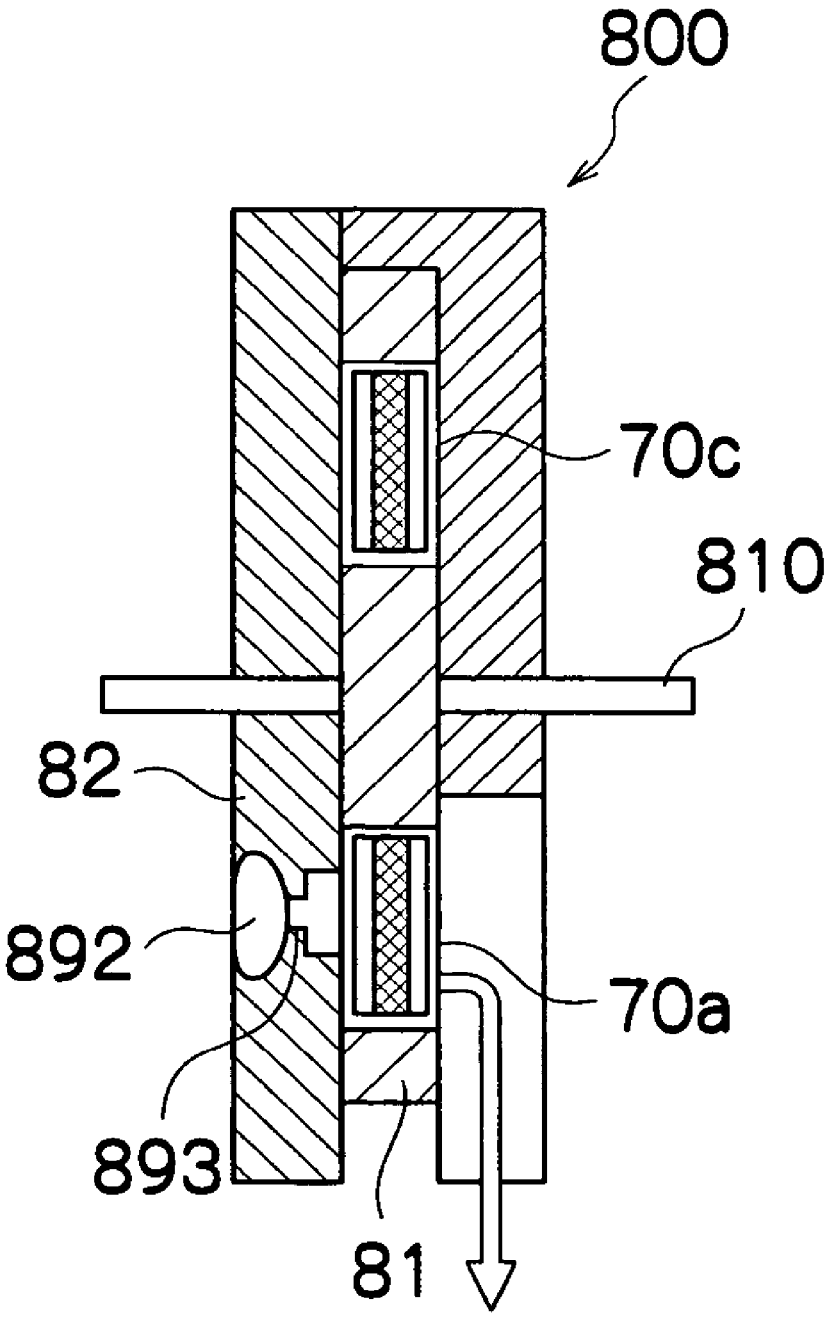
FIG. 15 is a sectional view showing an example of a folder provided with a device which pushes out and disposes of filters.

In another example of a folder 800 shown in FIG. 15, a filter discarding unit 892 is provided in the fixed unit 82. The filter 70*a* in the attachment position (discarding position) is detached from the rotary unit 81 by being pushed out by a pushing pin 893 provided in the filter discarding unit 892. The filter 70*a* then falls in the direction of the arrow in FIG. 15, and is stored in the discarded filter storage chamber 65, the door 651 of which is open as shown in FIG. 13B.

When the ink supply of the ink cartridge 60 has been consumed so that the ink cartridge 60 becomes unusable, the ink cartridge 60 is detached from the main body of the inkjet recording apparatus 10 such that the door 651 of the discarded filter storage chamber 65 closes as described above. The discarded filters stored in the discarded filter storage chamber 65 of the ink cartridges 60 are then collected by a supplier or the like. Hence, the user of the inkjet recording apparatus 10 does not need to be particularly aware of the discarded filters 70, and also does not have to dirty his/her hands or the like.

Figure 16:
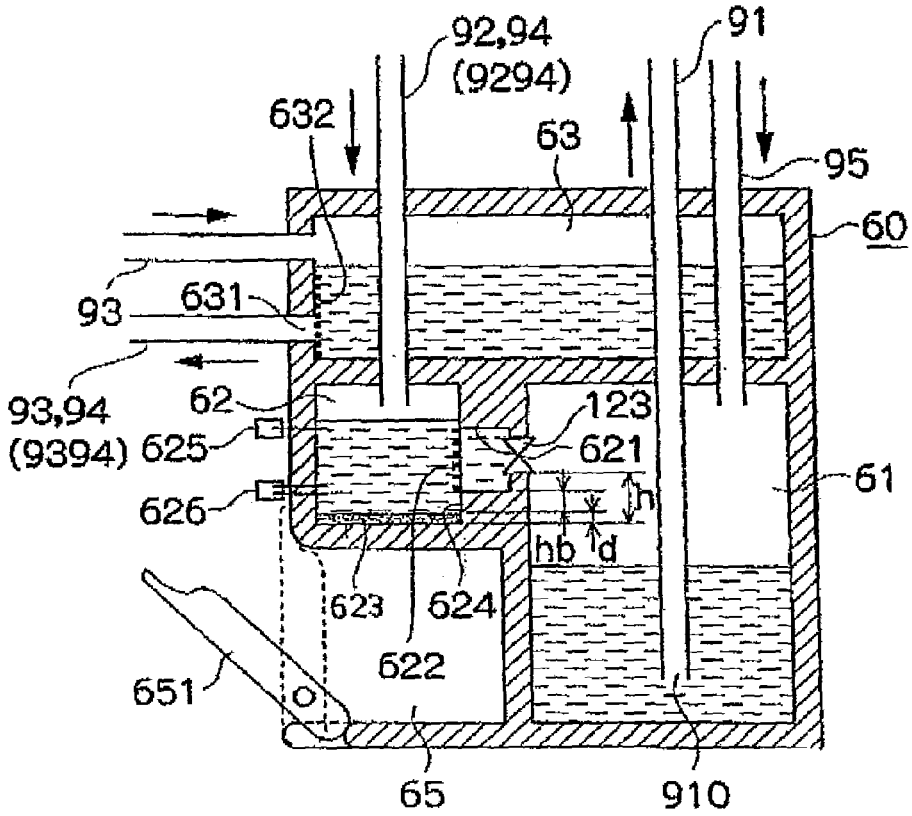
FIG. 16 is a projected view showing the internal constitution of an example of the ink cartridge.

FIG. 16 is an enlarged view of the ink cartridge 60 shown in FIG. 5.

In FIG. 16, a valve 123 (connecting portion opening/closing device) which opens and closes the connecting portion 621, and an ink transmission filter 622 which transmits liquid ink but prevents the transmission of foreign matter, are provided in the connecting portion 621 formed between the collected ink chamber 62 and ink supply chamber 61.

The viscous ink lumps, paper particles, and other non-dissolved foreign matter in the collected ink chamber 62 sink to the bottom face of the collected ink chamber 62 and accumulate (settle) there.

A porous member 623 (foreign matter trapping body) having a large number of minute holes is disposed on the bottom face of the collected ink chamber 62 to trap the foreign matter that sinks to the bottom face and accumulates there.

Representative examples of the porous member 623 include a porous material constituted by plant fibers such as cotton, hemp, or pulp, a porous material constituted by animal fibers such as wool, and a porous material constituted by a sponge-form synthetic resin, such as polyurethane or the like, comprising air bubbles.

As regards the positional relationship between the connecting portion 621 connecting the collected liquid chamber 62 to the liquid supply chamber 61 and the porous member 623, the opening of the connecting portion 621 is disposed in a higher position than the bottom face of the collected ink chamber 62, and the porous member 623 is disposed at a height between the height of the bottom face of the collected ink chamber 62 and the height of the opening of the connecting portion 621.

An obstructing wall 624 (dam) having a height hb is provided between the lower end of the opening of the connecting portion 621 and the upper end of the porous member 623 to hold in foreign matter that has not been trapped by the porous member 623. By means of this obstructing wall 624, even foreign matter that has not been trapped by the porous member 623 can be held in by the obstructing wall 624 having the height hb. In the example in FIG. 16, a height h of the connecting portion 621, a thickness d of the porous member 623, and the height hb of the obstructing wall 624 (the distance from the upper end of the porous member 623 to the upper end of the obstructing wall 624), have a relationship of $h>(hb+d)$, using the bottom face of the collected ink chamber 62 as a reference.

Further, a liquid level sensor 625 (liquid amount measurement sensor) which measures the amount of ink in the collected ink chamber 62, and an ink characteristic sensor 626 (liquid property measurement sensor) which is used to measure the ink characteristics (concentration, viscosity, or specific gravity) of the ink in the collected ink chamber 62, are provided on a side wall face of the collected ink chamber 62.

The liquid level sensor 625 is provided in a higher position than the connecting portion 621, and measures the amount of ink in the collected ink chamber 62 in accordance with its ON/OFF state.

The ink characteristic sensor 626 is provided in a higher position than the upper end of the porous member 623 (at the same height as the upper end of the obstructing wall 624, for example), and at the same height as, or a lower height than, the connecting portion 621.

Representative examples of the ink characteristic sensor 626 include an optical sensor and a pressure sensor.

Ink is preferably provided in the collected ink chamber 62 in its initial state so that the ink characteristic sensor 626 is equal to or lower than the liquid level even when the connecting portion opening/closing valve 123 is set in an open state.

The foreign matter in the collected ink chamber 62 is prevented from infiltrating the ink supply chamber 61 by the ink transmitting filter 622. As a result, the foreign matter sinks and is trapped by the porous member 623. With the foreign matter trapped by the porous member 623, the ink characteristic sensor 626 is used to measure the characteristics (physical properties) of the ink in the collected ink chamber 62, and the diluting fluid injection timing and injection amount are determined on the basis of the measured characteristics of the ink in the collected ink chamber 62.

By driving the third pump 113 shown in FIG. 5 to inject the diluting fluid in the diluting fluid chamber 63 into the collected ink chamber 62 through the dilution flow passage 94, the ink in the collected ink chamber 62 is diluted. The number of rotations and the driving time of the third pump 113 during this dilution operation are determined on the basis of the ink characteristics measured by the ink characteristic sensor 626. In other words, the diluting fluid injection amount is determined on the basis of the measured ink characteristics so that the ink in the collected ink chamber 62 obtains characteristics (concentration, viscosity, or specific gravity) which enable its reuse by the print head 50.

Once the ink in the collected ink chamber 62 has been converted into ink that can be reused in the print head 50 through settling of the foreign matter, trapping of the foreign matter, and dilution, the connecting portion opening/closing valve 123 is opened. The ink then passes through the ink transmission filter 622 and falls by force of gravity from the connecting portion 621 into the ink supply chamber 61.

The collected ink chamber 62 is formed on top of the discarded filter storage chamber 65, and the connecting portion 621 is provided to be higher than the position of the ink level in the ink supply chamber 61. In other words, the connecting portion 621 is provided such that when ink drops into the ink supply chamber 61, the ink in the ink supply chamber 61 is agitated.

A diluting fluid transmitting filter 632 (cleaning fluid transmitting filter) which transmits liquid diluting fluid (cleaning fluid) while preventing the transmission of foreign matter is provided in a supply port 631 of the diluting fluid chamber 63 (cleaning fluid chamber). In this embodiment, when cleaning the filter 70 in the folder 80, the diluting fluid that is used in the cleaning operation is collected in the diluting fluid chamber 63. Hence the diluting fluid that returns to the diluting fluid chamber 63 after cleaning the filter 70 contains the accumulated foreign matter from the filter 70 in the folder 80. The diluting fluid transmitting filter 632 prevents the foreign matter contained in the diluting fluid from flowing into the cleaning flow passage 93 and dilution flow passage 94.

Examples of the diluting fluid include pure water, and a liquid mixture of pure water and a solvent that is capable of dissolving viscous ink lumps, such as isopropyl alcohol, for example.

The ink cartridge 60 is provided with a signal terminal which is input with a control signal for controlling the opening and closing of the connecting portion opening/closing valve 123, a signal terminal which outputs the measurement results of the liquid level sensor 625, and a signal terminal which outputs the measurement results of the ink characteristic sensor 626. In other words, control of the opening and closing of the connecting portion opening/closing valve 123, recognition of the amount of ink in the collected ink chamber 62, and recognition of the characteristics of the ink in the collected ink chamber 62, can all be performed from the main body side of the inkjet recording apparatus 10.

Figure 17:
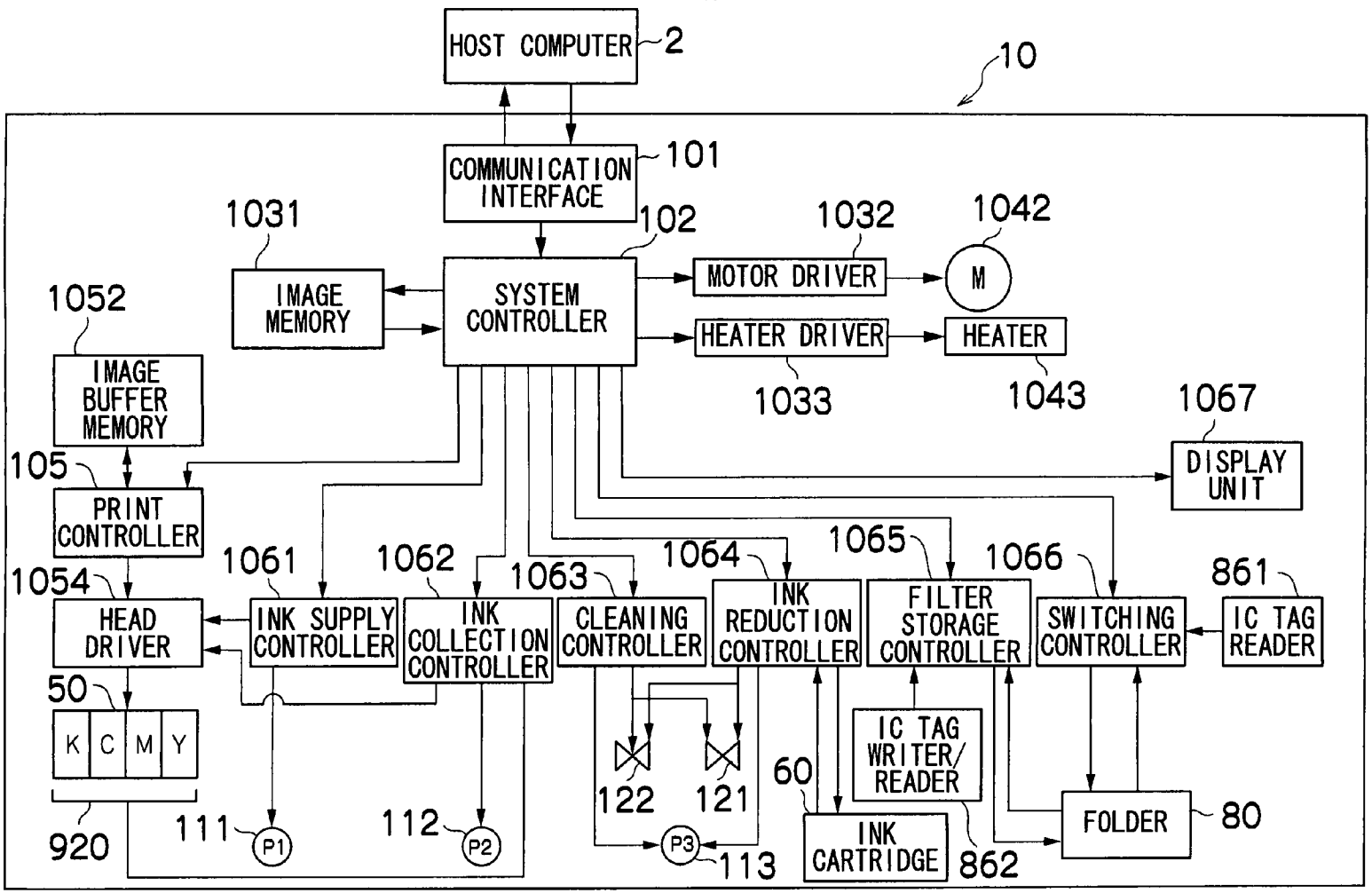
FIG. 17 is a block diagram showing an example of the system constitution of the inkjet recording apparatus.

FIG. 17 is a principal block diagram showing the system constitution of the inkjet recording apparatus 10. The inkjet recording apparatus 10 comprises a communication interface 101, a system controller 102, image memory 103 1, a motor driver 1032, a heater driver 1033, a print controller 105, an image buffer memory 1052, a head driver 1054, an ink supply controller 1061, an ink collection controller 1062, a cleaning controller 1063, an ink reduction controller 1064, a filter storage controller 1065, a switching controller 1066, a display unit 1067, and so on.

The communication interface 101 is an interface unit for receiving image data sent from a host computer 2. A communication interface such as USB, IEEE1394, Ethernet, or a wireless network may be used as the communication interface 101. The image data sent from the host computer 2 are received by the inkjet recording apparatus 10 through the communication interface 101, and temporarily stored in the image memory 1031. The image memory 1031 is a storage device for temporarily storing images inputted through the communication interface 101, and data is written and read to and from the image memory 1031 through the system controller 102. The image memory 1031 is not limited to a memory composed of semiconductor elements, and a hard disk drive or another magnetic medium may be used.

The system controller 102 is a control unit for controlling various units of the inkjet recording apparatus 10. The system controller 102 is constituted by a central processing unit (CPU), peripheral circuits thereof, and so on, and controls communications with the host computer 2 and writing and reading to and from the image memory 1031. The system controller 102 also generates control signals for controlling the motor 1042 and heater 1043 of the conveyance system.

The motor driver (drive circuit) 1032 drives the motor 1042 in accordance with commands from the system controller 102. The heater driver 1033 drives the heater 1043 of a post-drying unit 42 or the like in accordance with commands from the system controller 102.

The print controller 105 has a signal processing function for performing various tasks, corrections, and other types of processing for generating print control signals from the image data stored in the image memory 1031 in accordance with the control of the system controller 102. The print controller 105 supplies the generated print control signals (print data) to the head driver 1054. Prescribed signal processing is carried out in the print controller 105, and the ejection amount and the ejection timing of the ink droplets from the print head 50 are controlled via the head driver on the basis of the print data. In so doing, the desired dot size and dot placement can be achieved. The print controller 105 is provided with the image buffer memory 1052, and image data, parameters, and other data are stored temporarily in the image buffer memory 1052 during image data processing in the print controller 105. The head driver 1054 drives the actuators of the print head 50 of the colors on the basis of the print data supplied by the print controller 105.

The ink supply controller 1061 controls the supply of ink from the ink supply chamber 61 to the print head 50, which is performed by driving of the first pump 111.

The ink collection controller 1062 controls the collection of ink from the print head 50 into the collected ink chamber 62 via the cap 920, which is performed by driving the second pump 112.

The cleaning controller 1063 controls cleaning of the filter 70 using the diluting fluid (cleaning fluid) in the diluting fluid chamber 63, which is performed by driving the third pump 113. Cleaning of the filter 70 by the cleaning controller 1063 is performed independently of the ink supply performed by the ink supply controller 1061 and the ink collection performed by the ink collection controller 1062.

The ink reduction controller 1064 (dilution controller) dilutes the ink in the collected ink chamber 62 using the diluting fluid in the diluting fluid chamber 63 by driving the third pump 113, and thus controls reduction of the ink in the collected ink chamber 62 to ink that can be reused in the print head 50.

More specifically, the ink reduction controller 1064 determines the diluting fluid injection timing and injection amount on the basis of an output signal from the ink characteristic sensor 626 in the ink cartridge 60, and controls the drive timing, number of rotations, and driving duration of the third pump 113. In other words, the ink reduction controller 1064 controls the diluting fluid injection timing and injection amount.

The ink reduction controller 1064 also controls dropping of the ink in the collected ink chamber 62, which has been diluted to an appropriate degree, into the ink supply chamber 61. More specifically, the ink reduction controller 1064 controls the opening and closing of the connecting portion opening/closing valve 123 in the ink cartridge 60 on the basis of an output signal from the liquid level sensor 625 of the ink cartridge 60. In other words, the ink reduction controller 1064 controls the circulation timing and amount of the ink in the collected ink chamber 62 that is to be mixed into the ink supply chamber 61.

The filter storage controller 1065 controls the storage of used filters in the discarded filter storage chamber 65. In this embodiment, a determination as to whether the filter 70 is to be reused or discarded as a discarded filter is made on the basis of an output signal from the flow velocity sensor 853 of the folder 80, which measures the flow velocity of the cleaning flow passage, and the created usage history information of the filter 70. The usage history information of the filter 70 is created by the filter storage controller 1065. Alternatively, a timer (not shown) may be used to measure the usage time of the filter 70, and the determination as to whether or not to discard the filter 70 may be made on the basis of the measured usage time of the filter 70. Discarded filters are dropped into the discarded filter storage chamber 65 of the ink cartridge 60.

The switching controller 1066 controls the cyclical switching of the positions of the filters 70 by rotating the rotary unit 81 of the folder 80. The switching controller 1066 also determines whether or not the filter 70 can be used on the basis of the identification information of the filter 70, read from the IC tag 73 of the filter 70, and performs control to ensure that filters 70 determined to be unusable are not connected to a flow passage. When one of the filters 70 is determined to be unusable, the system controller 102 performs control to issue a warning using a buzzer or the like (not shown), and to display a warning message on the display unit 1067.

In this embodiment, the ink supply controller 1061, ink collection controller 1062, cleaning controller 1063, ink reduction controller 1064, filter storage controller 1065, and switching controller 1066 are constituted by microcomputers.

Figure 18:
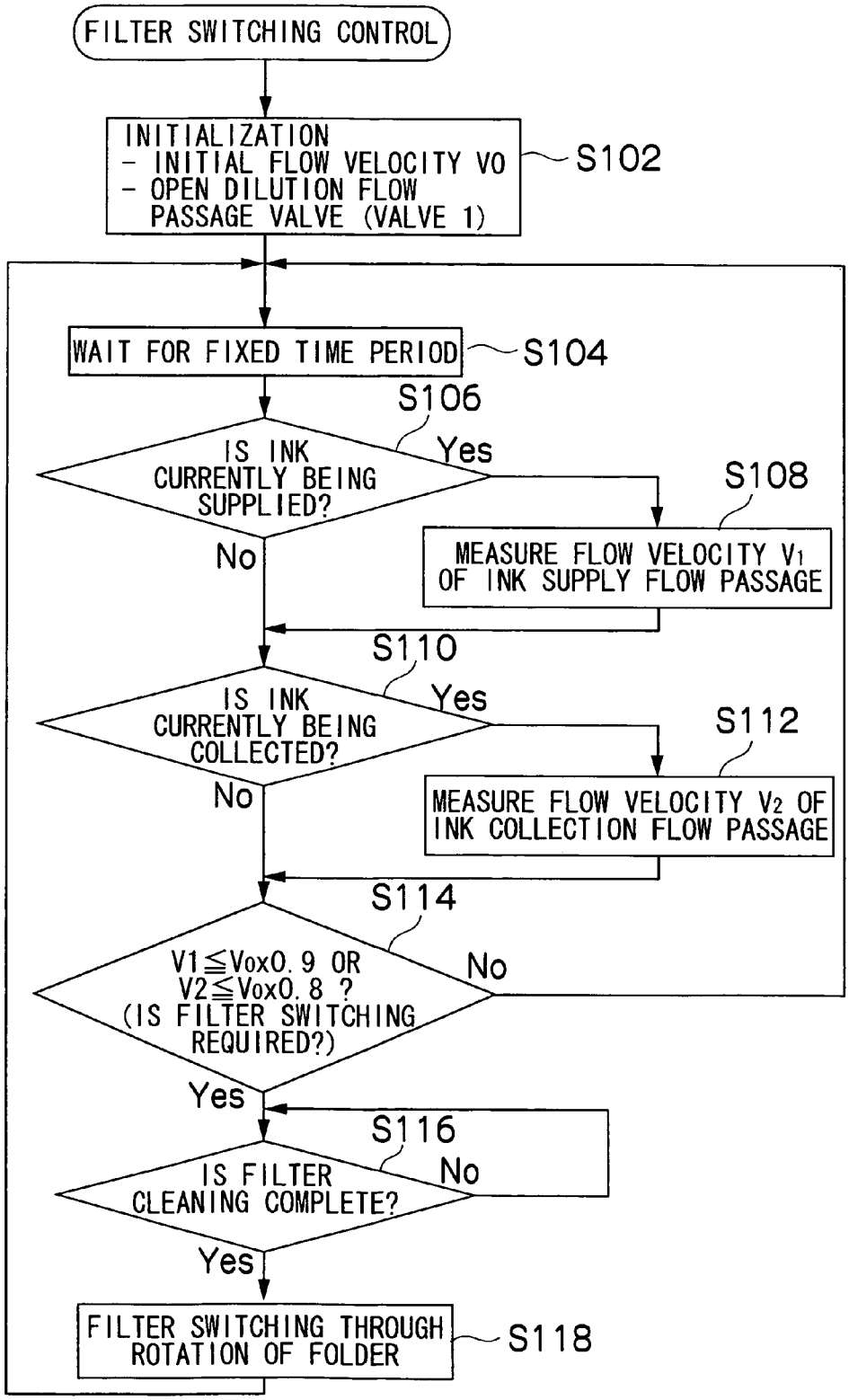
FIG. 18 is a schematic flowchart showing a processing example of filter switching control.

FIG. 18 illustrates an example of filter switching control processing, performed to switch the filters 70 connected to the ink supply flow passage 91, ink collection flow passage 92, and cleaning flow passage 93 in sequence by rotating the rotary unit 81 of the folder 80. This filter switching control processing is executed by the switching controller 1066 independently of the ink supply sequence executed under the control of the ink supply controller 1061, and the ink collection sequence executed under the control of the ink collection controller 1062.

In FIG. 18, first initialization is performed (S102). For ease of description, it is assumed that the initial flow velocities of the ink supply flow passage 91, ink collection flow passage 92, and cleaning flow passage 93 are all V0. Here, the initial flow velocity is the flow velocity when no foreign matter is present in the filter 70 in each flow passage. The dilution flow passage valve 121 (valve 1) is set in a closed state.

When initialization is complete, the process pauses for a fixed time period (SI 04), and then a determination is made as to whether or not ink is currently being supplied from the ink supply chamber 61 to the print head 50 through driving of the first pump 111 (S106). If ink is currently being supplied, the flow velocity V1 of the ink supply flow passage 91 is measured by the flow velocity sensor 851 (S108). Then, a determination is made as to whether or not ink from the print head 50 is currently being collected in the collected ink chamber 62 via the cap 920 through driving of the second pump 112 (S110). If ink is currently being collected, the flow velocity V2 of the ink collection flow passage 92 is measured by the flow velocity sensor 852 (S112).

A determination is then made on the basis of the measured flow velocities (the flow velocity V1 of the ink supply flow passage 91 and the flow velocity V2 of the ink collection flow passage 92) and the initial flow velocity V0 as to whether or not to switch the connection between the filters 70 held by the folder 80 and the respective flow passages (S114). More specifically, when the flow velocity V1 of the ink supply flow passage 91 falls to or below the initial flow velocity V0×0.9 due to the accumulation of foreign matter in the filter 70 that is connected to the ink supply flow passage 91, it is determined that the filters 70 must be switched. It is also determined that the filters 70 must be switched when the flow velocity V2 of the ink connection flow passage 92 falls to or below the initial flow velocity V0×0.8 due to the accumulation of foreign matter in the filter 70 that is connected to the ink collection flow passage 92. In other words, it is determined that the filters 70 must be switched when the flow velocity V1 of the ink supply flow passage 91 decreases not less than 10% from the initial flow velocity V0, or when the flow velocity V2 of the ink connection flow passage 92 decreases not less than 20% from the initial flow velocity V0.

When it is determined that the filters 70 must be switched, a determination is made as to whether or not cleaning of the filter 70 connected to the cleaning flow passage 93 is complete (S116). If cleaning of the filter 70 is still underway, the completion of cleaning is awaited, and if cleaning of the filter 70 is complete, the rotary unit 81 of the folder 80 is rotated to switch the filters 70 (S112). More specifically, the rotary unit of the folder 80 is rotated 45 degrees clockwise, as shown by the arrow in FIG. 7. As a result of this rotation, the filter 70*a* disposed in the attachment position is switched to the ink supply position and connected to the ink supply flow passage 91, the filter 70*b* disposed in the ink supply position and connected to the ink supply flow passage 91 is switched to the ink collection position and connected to the ink collection flow passage 92, the filter 70*c* disposed in the ink collection position and connected to the ink collection flow passage 92 is switched to the cleaning position and connected to the cleaning flow passage 93, and the filter 70*d* disposed in the cleaning position and connected to the cleaning flow passage 93 is switched to the attachment position (discarding position).

To prevent ink leakage when the filters 70 are switched, all of the opening/closing valves of the through holes 831 to 836 (the opening/closing valves 841, 842 of the through holes 831, 832 constituting a part of the ink supply flow passage 91, the opening/closing valves 843, 844 of the through holes 833, 834 constituting a part of the ink collection flow passage 92, and the opening/closing valves 845, 846 of the through holes 835, 836 constituting a part of the cleaning flow passage 93) formed in the fixed unit 82 of the folder 80, shown in FIGS. 10 and 11, are set in a closed state before the rotary unit 81 of the folder 80 is rotated. Once the positions of the filters 70 have been switched by rotating the rotary unit 81, all of the opening/closing valves 841 to 846 of the through holes 831 to 836 formed in the fixed unit 82 of the folder 80 are set in an open state.

Figure 19:
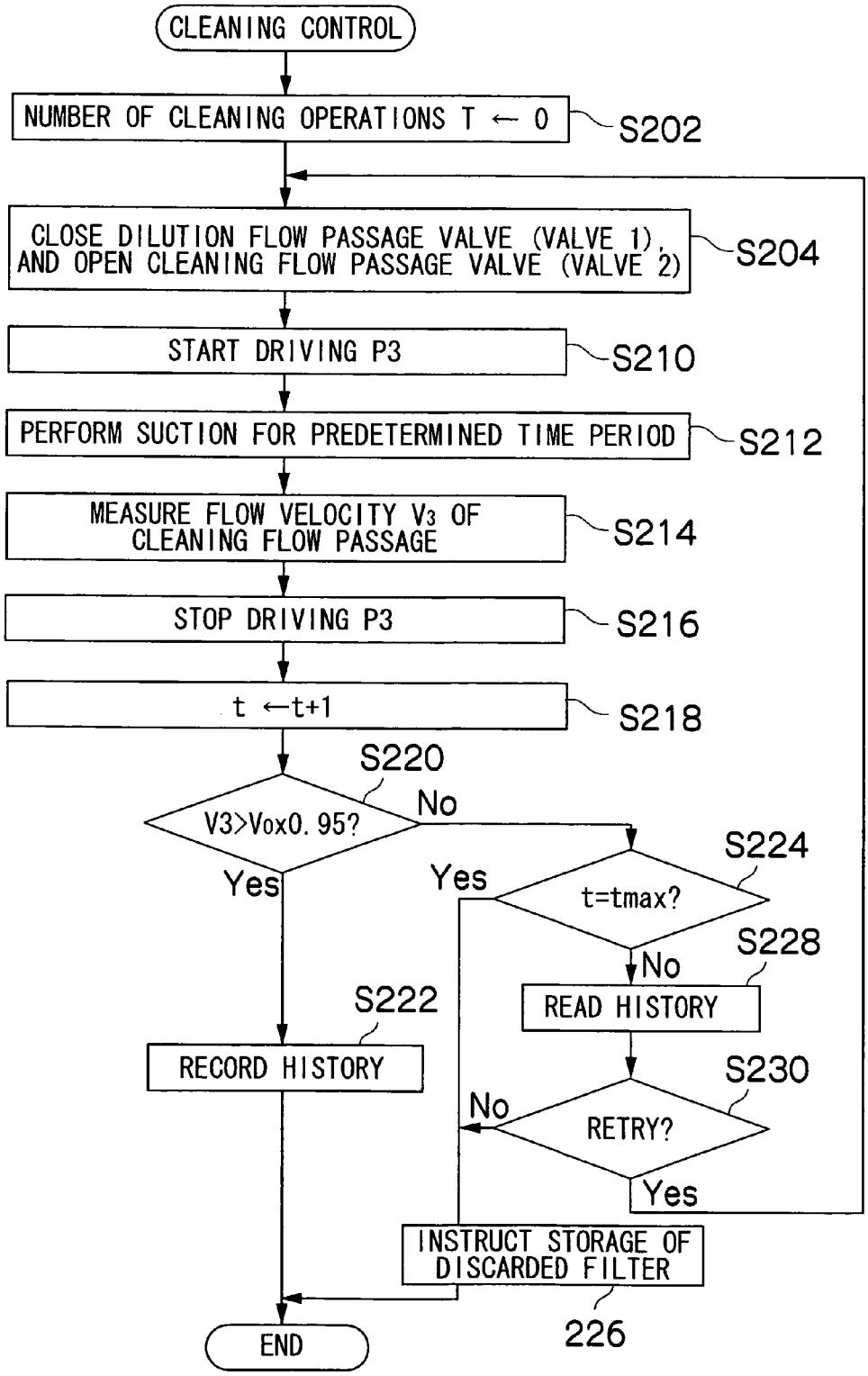
FIG. 19 is a schematic flowchart showing a processing example of cleaning control.

Next, filter cleaning control will be described. FIG. 19 is a schematic view of the flow of an example of cleaning control processing, which is performed principally when the filter 70 is connected to the cleaning flow passage 93 through rotation of the folder 80. This cleaning control is executed by the cleaning controller 1063.

In FIG. 19, when the filter 70 is disposed in the cleaning position, a number of cleaning operations t of the filter 70 is set to an initial value of "0" (S202). The dilution flow passage valve 121 (valve 1) is set in a closed state, and the cleaning flow passage valve 122 (valve 2) is set in an open state (S204). As a result, the cleaning flow passage 93 is connected completely from the diluting fluid chamber 63 (cleaning fluid chamber) and back to the diluting fluid chamber 63 through the filter 70 in the filter cleaning position.

The third pump 113 is driven to begin suctioning the diluting fluid (cleaning fluid) (S210). Suction is performed for a predetermined time period (S212), whereupon the flow velocity V3 of the cleaning flow passage 93 is measured by the flow velocity sensor 853 (S214). The third pump 113 is then halted (S216), whereupon the number of cleaning operations t is increased by one (S218).

A determination is then made on the basis of the measured flow velocity V3 of the cleaning flow passage and the initial flow velocity V0 as to whether or not the accumulated foreign matter in the filter 70 in the cleaning position has been removed to an extent enabling reuse of the filter 70 (S220). More specifically, when the flow velocity V3 of the cleaning flow passage 93 exceeds the initial flow velocity V0×0.95, it is determined that the foreign matter in the filter 70 has been removed sufficiently to enable reuse of the filter 70. On the other hand, when the flow velocity V3 of the cleaning flow passage 93 is equal to or less than the initial flow velocity V0×0.95, it is determined that that the foreign matter in the filter 70 has not been removed sufficiently to enable reuse of the filter 70.

When it is determined that the foreign matter in the filter 70 has been removed sufficiently, usage history information such as that shown in FIG. 20 (the number of uses of the filter 70, the number of cleaning operations t, the flow velocity V3 of the cleaning flow passage 93 upon completion of the cleaning operation, and so on) is recorded (S222). The "number of uses" is preset to an initial value of "1" when the filter 70 is attached to the rotary unit 81 of the folder 80, and incremented and recorded in the step S222. Furthermore, values taken when it is determined that the filter 70 has been cleaned sufficiently are recorded as the number of cleaning operations t and the flow velocity V3.

When it is determined that the foreign matter in the filter 70 has not been removed sufficiently, the number of cleaning operations t is compared to a predetermined maximum allowable number of cleaning operations tmax (S224). When the number of cleaning operations t has reached the maximum allowable number of cleaning operations tmax, an instruction is issued to store the filter 70 in the discarded filter storage chamber 65 (S226). Actual storage of the filter 70 in the discarded filter storage chamber 65 is performed during the next folder rotation. When the number of cleaning operations t has not reached the maximum allowable number of cleaning operations tmax, the filter usage history information is read (S228), and a determination is made on the basis of the read usage history information as to whether or not to reattempt filter cleaning (S230). This determination is made taking all of the number of uses, the number of cleaning operations t, and the flow velocity V3 of the cleaning flow passage 93 into account. A method of making this determination on the basis of the number of uses alone also exists.

Next, using FIG. 21, an example of dilution control processing will be described. This dilution control is performed by the ink reduction controller 1064.

Figure 21:
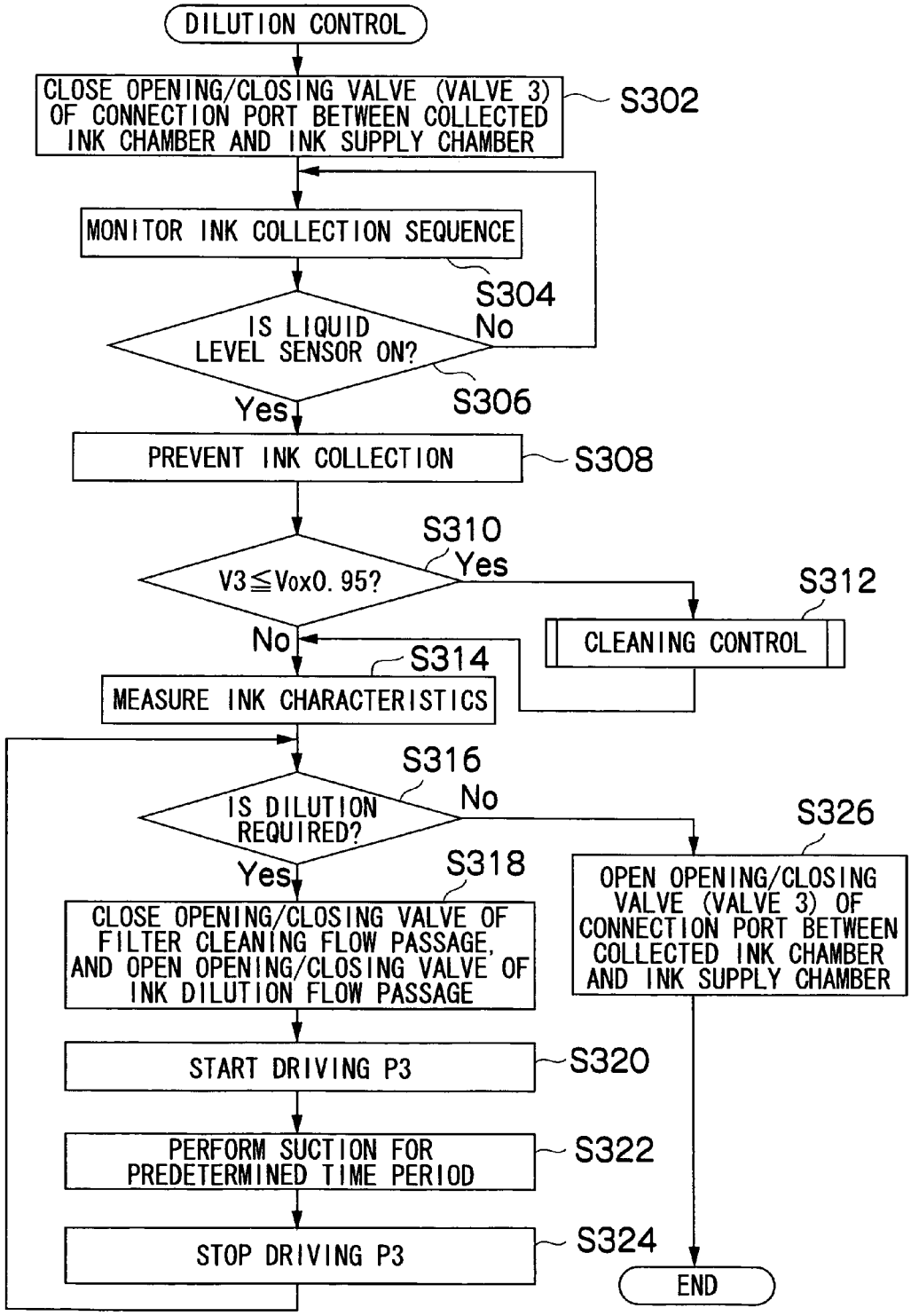
FIG. 21 is a schematic flowchart showing a processing example of dilution control.

In FIG. 21, first initialization is performed (S302). Here, the connecting portion opening/closing valve 123 (valve 3) provided in the connecting portion 621 between the collected ink chamber 62 and ink supply chamber 61 is set in a closed state.

The completion of a predetermined ink collection sequence is monitored (S304), and a determination is made as to whether or not the liquid level sensor 625 which measures the amount of ink in the collected ink chamber 62 is ON or OFF (S306). When the liquid level sensor 625 is OFF (i.e. when a sufficient amount of ink to be dropped into the ink supply chamber 61 via the connecting portion 621 has not yet accumulated in the collected ink chamber 62), the end of the ink collection sequence continues to be monitored (S304), and when the liquid level sensor 625 is ON (i.e. when a sufficient amount of ink to be dropped into the ink supply chamber 61 via the connecting portion 621 has accumulated in the collected ink chamber 62), the following processing is performed.

In the constitutional example shown in FIG. 5, a part of the dilution flow passage 94 is shared with the ink collection flow passage 92, and therefore ink collection processing is prevented from beginning until dilution processing is complete (S308). When the dilution flow passage 94 is constituted separately from the ink collection flow passage 92, ink dilution may be performed in parallel with ink collection.

Further, in the constitutional example shown in FIG. 5, a part of the dilution flow passage 94 is shared with the cleaning flow passage 93, and therefore a determination is made as to whether or not the flow velocity V3 of the cleaning flow passage 93 during filter cleaning using the diluting fluid (cleaning fluid) is within or outside of an allowable range (S310). More specifically, when the flow velocity V3 is equal to or less than the initial flow velocity V0×0.95, it is determined that the flow velocity V3 is outside of the allowable range, and the cleaning processing shown in FIG. 19 is performed (S312). The dilution flow passage 94 may be formed separately from the cleaning flow passage 93.

Next, the ink characteristics (concentration, viscosity, or specific gravity) are measured using the ink characteristic sensor 626 in the collected ink chamber 62 (S314), and the measurement results are compared with predetermined conditions to determine whether or not the ink in the collected ink chamber 62 needs to be diluted (S316). If the ink viscosity exceeds a predetermined threshold, for example, it is determined that the ink needs to be diluted.

When it is determined that dilution is necessary, the cleaning flow passage valve 122 (valve 2) is set in a closed state, and the dilution flow passage valve 121 (valve 1) is set in an open state (S318). In so doing, the dilution flow passage 94 is connected completely from the diluting fluid chamber 63 to the collected ink chamber 62. Diluting fluid suction is then commenced by driving the third pump 113 (S320). Suction is continued for a predetermined time period, which is calculated on the basis of the output signal from the ink characteristic sensor 626 (S322), whereupon the third pump 113 is halted (S324). As a result, a predetermined amount of diluting fluid is injected into the collected ink chamber 62 for a predetermined time period.

After the predetermined amount of diluting fluid has been injected into the collected ink chamber 62 for the predetermined time period, the ink characteristics are measured, and a determination is made as to whether or not the measurement results satisfy the predetermined conditions (S314). When the characteristics of the ink in the collected ink chamber 62 satisfy the predetermined conditions, the connecting portion opening/closing valve 123 (valve 3) between the collected ink chamber 62 and ink supply chamber 61 is set in an open state (S326). In so doing, the ink that has been diluted to an appropriate degree is dropped into the ink supply chamber 61 via the ink transmission filter 622 that is disposed in the connecting portion 621.

An example has been described above in which the filter 70, which can be attached to and detached from the flow passages through which the foreign matter-containing ink flows, is connected in circular succession to the ink supply flow passage 91, ink collection flow passage 92, and cleaning flow passage 93. However, depending on the constitution of the flow passages in the inkjet recording apparatus 10 and the need to clean the filter 70, the combination of flow passages to which the filter 70 is connected and the connection sequence may differ from those of the embodiment described above. For example, the filter 70 may be connected to the ink collection flow passage 92 and cleaning flow passage 93 alternately, and not connected to the ink supply flow passage 91. Alternatively, the filter 70 may be connected to the ink supply flow passage 91 and cleaning flow passage 93 alternately, and not connected to the ink connection flow passage 92. Further, cleaning of the filter 70 may be omitted such that the filter is connected to the ink supply flow passage 91 and ink collection flow passage 92 in succession, and then stored in the discarded filter storage chamber 65.

Further, four positions of the filter 70 have been described, namely the attachment position (also serving as the discarding position), the ink supply position, the ink collection position, and the cleaning position (also serving as a writing/reading position for writing and reading usage history information into and from the IC tag 73). However, five or more positions may be provided. For example, the attachment position and discarding position may be provided separately, the cleaning position and writing/reading position may be provided separately, and a writing position and reading position may be provided separately.

Furthermore, an example has been described above in which the filters 70 are switched by being rotated in accordance with the rotation of the rotary unit 81 in the folder 80, but the present invention is not limited to a case in which the filters 70 are rotated. For example, the filters 70 may be moved linearly.

Further, the number of filters 70 that can be held by the folder 80 is not limited to four. The folder 80 preferably holds a larger number of filters 70 than the number of flow passages to which the filters 70 are to be connected. In other words, it is preferable to provide a stand-by filter 70 that can be used when a filter is discarded.

Further, an example has been described above in which the usage history information of the filter 70 is written into the IC tag 73 provided on the filter 70, but the usage history information may be stored in the memory of the inkjet recording apparatus 10, in which case the IC tag writer/reader 862 may be omitted.

Also, in the example described above, the ink characteristic sensor 626 is provided in the collected ink chamber 62, and the injection timing and injection amount of the diluting fluid are determined on the basis of the characteristics of the ink in the collected ink chamber 61. However, the characteristics of the ink in the ink supply chamber 61 may also be measured such that the injection timing and injection amount of the diluting fluid are determined on the basis of both the characteristics of the ink in the ink supply chamber 61 and the characteristics of the ink in the collected ink chamber 62.

Further, a case has been described above in which switching of the filters 70 is performed on the basis of the measurement results of a device for measuring flow passage resistance (flow passage resistance measurement device), such as the flow velocity sensor 851 provided in the ink supply flow passage 91 and the flow velocity sensor 852 provided in the ink collection flow passage 92. However, the flow passage resistance measurement device may be omitted, and switching of the filters 70 may be performed on the basis of the usage time of the filters 70, measured by a timer. Moreover, a case has been described in which the presence of a discarded filter is determined on the basis of the measurement results of a device for measuring flow passage resistance such as the flow velocity sensor 853 provided in the cleaning flow passage 93. However, the presence of a discarded filter may be determined on the basis of the usage time of the filters 70, measured by a timer, whereupon the discarded filter is stored in the discarded filter storage chamber 65.

Also in the example described above, the collected ink chamber 62 is formed above the discarded filter storage chamber 65, but the present invention is not limited to this constitution, and includes an aspect in which the collected ink chamber 62 is formed above the diluting fluid chamber 63, and an aspect in which the collected ink chamber 62 is formed above the ink supply chamber 61. In either case, the present invention is constituted such that the ink transmitted to the ink supply chamber 61 from the collected ink chamber 62 falls into the ink supply chamber 61 and agitates the ink in the ink supply chamber 61.

Furthermore, the case described above employs the filters 70 that can be attached to and detached from the flow passages (ink supply flow passage 91, ink collection flow passage 92, cleaning flow passage 93) through which foreign matter-containing ink flows, and the filters 631, 632 provided in the ink cartridge. However, depending on the ratio between the amount of generated foreign matter and the amount of liquid consumed by the print head 50, the filters 70 that can be attached to and detached from the flow passages may be omitted.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection apparatus, comprising:

a liquid ejection unit which ejects a liquid;

a liquid storage unit which stores the liquid to be supplied to the liquid ejection unit;

a plurality of flow passages through which the liquid flows; and a switching unit which holds a removable filter to trap foreign matter and switches a position of the filter so that the filter is connected to each of the plurality of flow passages in succession.

2. The liquid ejection apparatus as defined in claim 1, wherein the switching unit switches the position of the filter using as connection subjects at least two flow passages from among a liquid supply flow passage which supplies the liquid stored in the liquid storage unit to the liquid ejection unit, a liquid collection flow passage which collects the liquid ejected from the liquid ejection unit for reuse by the liquid ejection unit, and a cleaning flow passage which removes accumulated foreign mailer from the filter.

3. The liquid ejection apparatus as defined in claim 1, wherein the switching unit connects the filter that is connected for use to a liquid supply flow passage which supplies the liquid stored in the liquid storage unit to the liquid ejection unit, to a liquid collection flow passage which collects the liquid ejected from the liquid ejection unit for reuse by the liquid ejection unit.

4. The liquid ejection apparatus as defined in claim 1, wherein the switching unit connects the filter to a cleaning flow passage which removes accumulated foreign matter from the filter, and then connects the cleaned filter to at least one of a liquid supply flow passage which supplies the liquid stored in the liquid storage unit to the liquid ejection unit, and a liquid collection flow passage which collects the liquid ejected from the liquid ejection unit for reuse by the liquid ejection unit.

5. The liquid ejection apparatus as defined in claim 1, wherein the switching unit is capable of holding a larger number of the filters than a number of connection subject flow passages.

6. The liquid ejection apparatus as defined in claim 1, further comprising: a reading unit which reads identification information indicating a type of the filter from a storage unit provided on the filter; and a switching control unit which determines whether or not the filter is usable according to the identification information, and performs control to ensure that when the filter is determined to be unusable, the filter is not connected to the flow passages.

7. The liquid ejection apparatus as defined in claim 1, further comprising a discarded filter storage unit which stores a used and discarded filter.

8. The liquid ejection apparatus as defined in claim 7, further comprising a filter storage control unit which determines whether the filter is a usable filter or a discarded filter according to at least one of a flow velocity of the flow passage to which the filter is connected and a usage time of the filter, and performs control to ensure that the discarded filter is stored in the discarded filter storage unit.

9. The liquid ejection apparatus as defined in claim 7, further comprising a filter storage control unit which creates usage history information of the filter, determines whether the filter is a usable filter or a discarded filter according to the usage history information, and performs control to ensure that the discarded filter is stored in the discarded filter storage unit.

10. The liquid ejection apparatus as defined in claim 7, wherein the discarded filter storage unit is formed together with the liquid storage unit in a cartridge that can be attached to and detached from a main body of the liquid ejection apparatus.

11. The liquid ejection apparatus as defined in claim 10, wherein the discarded filter storage unit comprises an opening/closing unit which is set in an open state enabling storage of the filter when the cartridge is attached to the main body of the liquid ejection apparatus, and set in a closed state preventing the stored filter from escaping when the cartridge is detached from the main body of the liquid ejection apparatus.

12. A liquid tank, comprising:

a liquid supply chamber which stores a liquid to be supplied;

a collected liquid chamber formed b faces definin an enclosed s ace and which stores a collected liquid;

a connecting portion which connects the collected liquid chamber to the liquid supply chamber and has an opening disposed in a higher position than a bottom face of the collected liquid chamber;

a foreign mailer trapping body which traps foreign matter in the collected liquid chamber and is disposed between the bottom face of the collected liquid chamber and the opening of the connecting portion; and a filter which is disposed in the connecting portion and transmits the liquid from the collected liquid chamber to the liquid supply chamber, but prevents transmission of the foreign matter.

13. The liquid tank as defined in claim 12, wherein the liquid tank is detachably attached to a liquid ejection apparatus which deposits the liquid in the liquid supply chamber onto a predetermined recording medium.

14. The liquid tank as defined in claim 12, further comprising a diluting fluid chamber which stores a diluting fluid for diluting the liquid collected in the collected liquid chamber.

15. The liquid tank as defined in claim 12, further comprising a liquid property measurement sensor which measures physical properties of the liquid in the collected liquid chamber and is disposed in a higher position than an upper end of the foreign matter trapping body.

16. The liquid tank as defined in claim 12, wherein the connecting portion is provided with an opening/closing device which opens and closes the connecting portion.

17. The liquid tank as defined in claim 12, further comprising a liquid amount measurement sensor which measures an amount of the liquid in the collected liquid chamber and is disposed in a higher position than an upper end of the foreign matter trapping body.

18. The liquid tank as defined in claim 12, wherein the collected liquid chamber is disposed to ensure that the liquid is dropped into the liquid supply chamber from the collected liquid chamber.

19. A liquid ejection apparatus, comprising:

the liquid tank as defined in claim 12;

a liquid ejection unit which ejects the liquid stored in the liquid supply chamber of the liquid tank; and a dilution control unit which controls an injection amount of a diluting fluid that is injected into the collected liquid chamber of the liquid tank, wherein the liquid that is collected in the collected liquid chamber of the liquid tank from the liquid ejection unit is diluted under control of the dilution control unit.

20. A liquid tank, comprising:

a liquid supply chamber which stores a liquid to be supplied;

a collected liquid chamber which stores a collected liquid;

a connecting portion which connects the collected liquid chamber to the liquid supply chamber and has an opening disposed in a higher position than a bottom face of the collected liquid chamber;

a foreign matter trapping body which traps foreign matter in the collected liquid chamber and is disposed between the bottom face of the collected liquid chamber and the opening of the connecting portion; and a filter which is disposed in the connecting portion and transmits the liquid from the collected liquid chamber to the supply liquid chamber, but prevents transmission of the foreign matter, wherein the collected liquid chamber has a room storing the collected liquid above a surface of the foreign matter trapping body on a side of the connecting portion.

21. The liquid tank as defined in claim 20, further comprising a flow passage which is connected to the room to lead the collected liquid into the collected liquid chamber.

22. A liquid ejection unit comprising:

a folder holding a plurality of removable filters for trapping foreign matter, a rotary unit for rotating the folder to a plurality of flow positions, each of said flow positions aligning flow passages with a number of said removable filters, a switching unit for controlling said rotary unit to present said removable filters to said flow positions dependent upon the condition of the filters, whereby the working life of each filter can be extended and filters can be replaced without interruption of the trapping of foreign matter.

* * * * *